US010995407B2

(12) United States Patent
Utsumi et al.

(10) Patent No.: US 10,995,407 B2
(45) Date of Patent: May 4, 2021

(54) SURFACE TREATING APPARATUS AND SURFACE TREATMENT METHOD

(71) Applicant: C. Uyemura & Co., Ltd., Osaka (JP)

(72) Inventors: Masayuki Utsumi, Osaka (JP); Masaharu Takeuchi, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 16/727,302

(22) Filed: Dec. 26, 2019

(65) Prior Publication Data

US 2020/0224314 A1 Jul. 16, 2020

(30) Foreign Application Priority Data

Jan. 10, 2019 (JP) ..... JP2019-002863

(51) Int. Cl.

| | |
|---|---|
| ***C23C 18/16*** | (2006.01) |
| ***C23C 18/18*** | (2006.01) |
| ***B05C 5/00*** | (2006.01) |
| ***B05C 5/02*** | (2006.01) |

(52) U.S. Cl.

CPC ..... *C23C 18/1632* (2013.01); *B05C 5/002* (2013.01); *B05C 5/0208* (2013.01); *C23C 18/1628* (2013.01); *C23C 18/1844* (2013.01)

(58) Field of Classification Search

None

See application file for complete search history.

(56) References Cited

U.S. PATENT DOCUMENTS 1,628,431 A * 5/1927 Roby ..... B05C 3/02 118/421

2,168,821 A * 8/1939 Elliott ..... A01M 7/0042 239/157

(Continued)

FOREIGN PATENT DOCUMENTS

JP 2014-088600 A 5/2014

OTHER PUBLICATIONS

Notification of Reasons for Refusal (Including Translation) for corresponding Japanese Patent Application No. 2019-002863, dated Sep. 7, 2020.

(Continued)

*Primary Examiner* — Jethro M. Pence

(74) *Attorney, Agent, or Firm* — Jason H. Vick; Sheridan Ross, PC

(57) ABSTRACT

In a flow down type surface treating apparatus, a scattering amount of a processing solution Q is reduced.

A honeycomb member 60 is provided vertically below a transport hanger 16. The honeycomb member 60 consists of a plurality of tubular members with hexagonal holes connected together. When the processing solution Q falls in a vertical direction (in the direction of an arrow α), the processing solution Q passes through through-holes of the honeycomb member 60. When the processing solution Q hits liquid level H, a part of it is reflected. Since a part of the reflected processing solution Q is reflected obliquely, it collides with an inner wall of the through-hole of the honeycomb member 60. As a result, the amount of the treatment liquid Q that emerges again on an upper surface of the through-holes is reduced. Thereby, the honeycomb member 60 exhibits a scattering prevention function.

11 Claims, 20 Drawing Sheets

(56) References Cited

U.S. PATENT DOCUMENTS

| | | | | |
|---|---|---|---|---|
| 2003/0077396 | A1* | 4/2003 | LeCompte | B05C 3/09 427/430.1 |
| 2014/0053774 | A1* | 2/2014 | Hotta | B05B 16/20 118/423 |
| 2014/0116334 | A1 | 5/2014 | Hotta et al. | |
| 2018/0087140 | A1* | 3/2018 | Utsumi | C23C 4/04 |
| 2018/0100237 | A1* | 4/2018 | Utsumi | C23C 18/1619 |
| 2018/0110128 | A1* | 4/2018 | Utsumi | H05K 3/227 |
| 2018/0117618 | A1* | 5/2018 | Utsumi | B05C 11/11 |

OTHER PUBLICATIONS

Notification of Reasons for Refusal (Including Translation) for corresponding Japanese Patent Application No. 2019-002872, dated Sep. 7, 2020.

* cited by examiner

60 / HONEYCOMB MEMBER
61 / THROUGH-HOLE

FIG.14

| No | Condition | Offset M mm | Partition height L1 mm | Amount of jumping out water mL / 30 min |
|---|---|---|---|---|
| 1 | Bottom plate only | 180 | 60 | 330 |
| 2 | | | 160 | 36 |
| 3 | | | 260 | 7 |
| 4 | | 100 | 60 | 330 |
| 5 | | | 160 | 32 |
| 6 | With water (depth of 20 mm) on bottom plate | 180 | 60 | 100 |
| 7 | With honeycomb member HC1 on bottom plate | 180 | 60 | 15 |
| 8 | | 100 | 60 | 15 |
| 9 | With honeycomb member HC2 on bottom plate | 180 | 60 | 71 |

79 / SPLASHING DIRECTION CONVERTING PART

81 / VERTICAL PIPE MEMBER
88 / HORIZONTAL PIPE MEMBER

60 / HONEYCOMB MEMEBER
81 / VERTICAL PIPE MEMBER
84, 85 / SLOPE
88 / HORIZONTAL PIPE MEMBER

SURFACE TREATING APPARATUS AND SURFACE TREATMENT METHOD

CROSS REFERENCE TO RELATED APPLICATIONS

This application claims the benefit under 35 U.S.C. 119(a) to Japanese Patent Application No. JP 2019-002863, filed Jan. 10, 2019, the entire disclosure of which is incorporated herein by reference in its entirety.

BACKGROUND OF TIRE INVENTION

Field of the Invention

The present invention relates to a flow down type surface treating apparatus, and more particularly to prevention of liquid splashing into an adjacent treatment chamber.

Background Art

FIG. 10 of Patent Document 1 discloses a flow down type surface treating apparatus in which an antiscattering member is provided under a work.

[Patent Document 1] Japanese Patent Application Publication No. 2014-88600 (JP 2014-88600 A)

As anti scattering members of Patent Document 1, a sponge, a filter, and a fibrous material ("Kasen Rock™" manufactured by Toyo Cushion Co., Ltd.) are disclosed (paragraph 0085 of Patent Document 1). However, these are not always sufficiently effective since droplets hitting the surface of the antiscattering member are reflected as they are. When such reflection occurs, liquid may be mixed into an adjacent treatment chamber.

In order to solve such a problem, the distance between the treatment chambers may be increased, or the lower surface of a partition provided between the treatment chambers may be set considerably higher than a reflection surface of the droplets. However, this causes the apparatus in whole to become larger.

The present invention is aimed for solving the above-described problem and providing a flow down type surface treating apparatus that enables downsizing without the liquid being mixed into the adjacent treatment chamber.

SUMMARY OF INVENTION

A surface treating apparatus according to the present invention includes: a first treatment chamber in which a treatment object is carried in a vertically held state; a first processing solution flow down mechanism, provided in the first treatment chamber, for squirting a first processing solution to flow down from an upper portion of the carried treatment object over a surface region of the vertically held treatment object; a second treatment chamber adjacent to the first treatment chamber in which the treatment object is carried in the vertically held state; a second processing solution flow down mechanism, provided in the second treatment chamber, for squirting a second processing solution to flow down from the upper portion of the carried treatment object over a surface region of the vertically held treatment object; a partition wall, provided between the first treatment chamber and the second treatment chamber, having a carry-in opening that enables the treatment object to be carried in through the carry-in opening in the vertically held state; and a mixing reduction mechanism, provided in the first treatment chamber or the second treatment chamber in a vicinity of the partition wall, for reducing an amount of the splashed processing solution, which flowed down from a lower portion of the treatment object and has been reflected by a landing surface, being mixed into the adjacent treatment chamber through the carry-in opening, in which the mixing reduction mechanism is arranged to have a plurality of vertically long individual tubular members so that their openings are oriented to face a vertical direction.

When the processing solution that has passed through openings is reflected by the landing surface, the processing solution collides with inner walls of the vertically long individual tubular members, and falls toward the landing surface. This makes it possible to provide the flow down type surface treating apparatus that enables downsizing without the liquid being mixed into the adjacent treatment chamber.

In this specification, the term "honeycomb-like shape" refers to a shape that a plurality of individual tubular members having polygonal or circular cross-sections are arranged so that their openings are oriented to face the vertical direction. In addition, among the structure with "honeycomb-like shape", the term "honeycomb structure" refers to structure whose individual tubular members have hexagonal cross-sections.

A state defined by the term "flow down from the upper portion to the lower portion" is not limited as long as it results in a state of the processing solution flowing down from the upper portion to the lower portion of the treatment object, and it includes a case where the processing solution is directly squirted toward the treatment object to flow down and a case where the processing solution is indirectly applied to flow down through a holding part that holds the treatment object.

Features, other objectives, uses, effects, and the like of the present invention will become apparent by referring to the embodiments and the drawings.

BRIEF DESCRIPTION OF THE DRAWINGS

FIG. 14 is a table showing results of the confirmation experiment of the scattering prevention effect.

DETAILED DESCRIPTION OF PREFERRED EMBODIMENTS

1. First Embodiment

Figure 1:
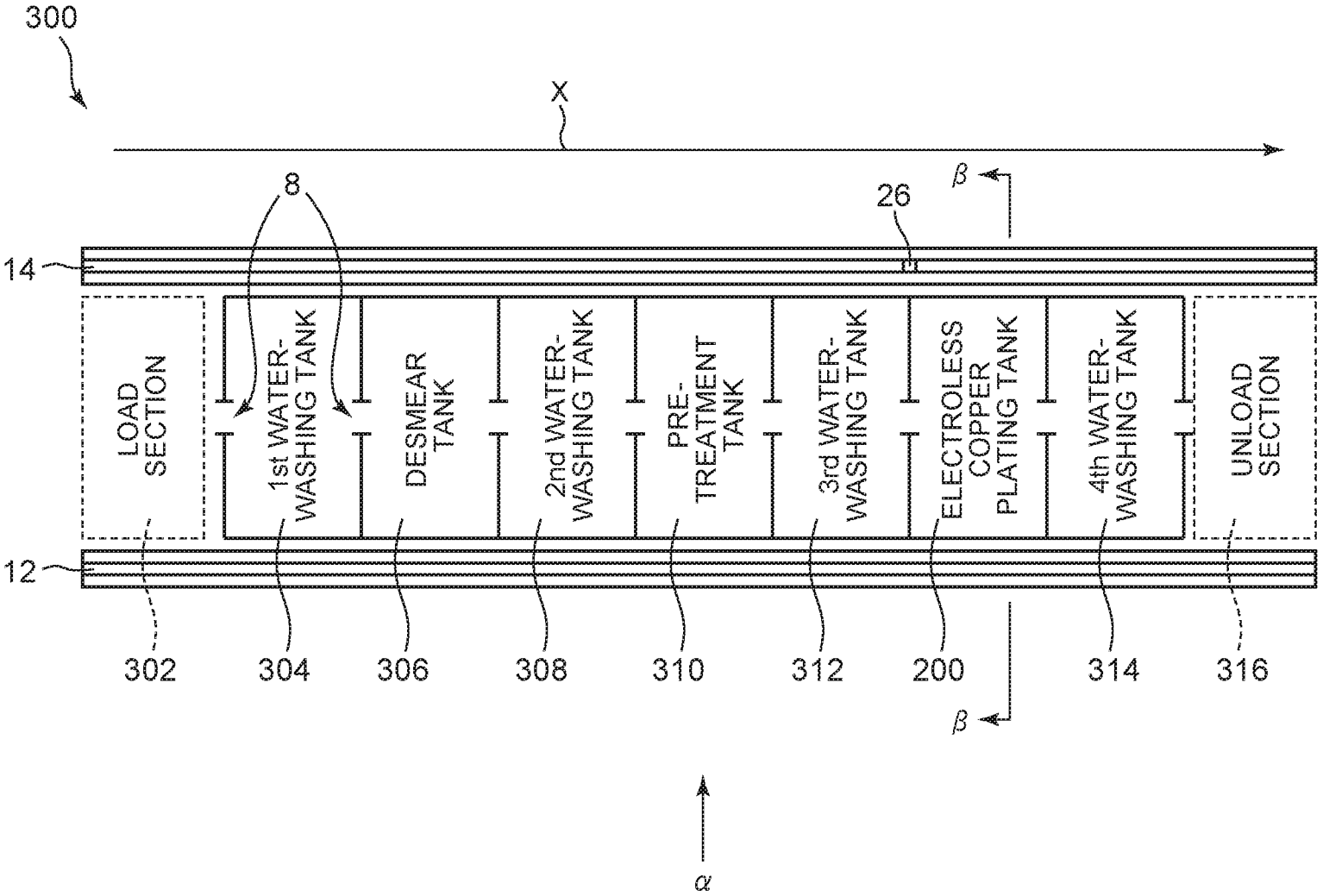
FIG. 1 is an arrangement plan of a surface treating apparatus 300 seen from above.
Figure 2:
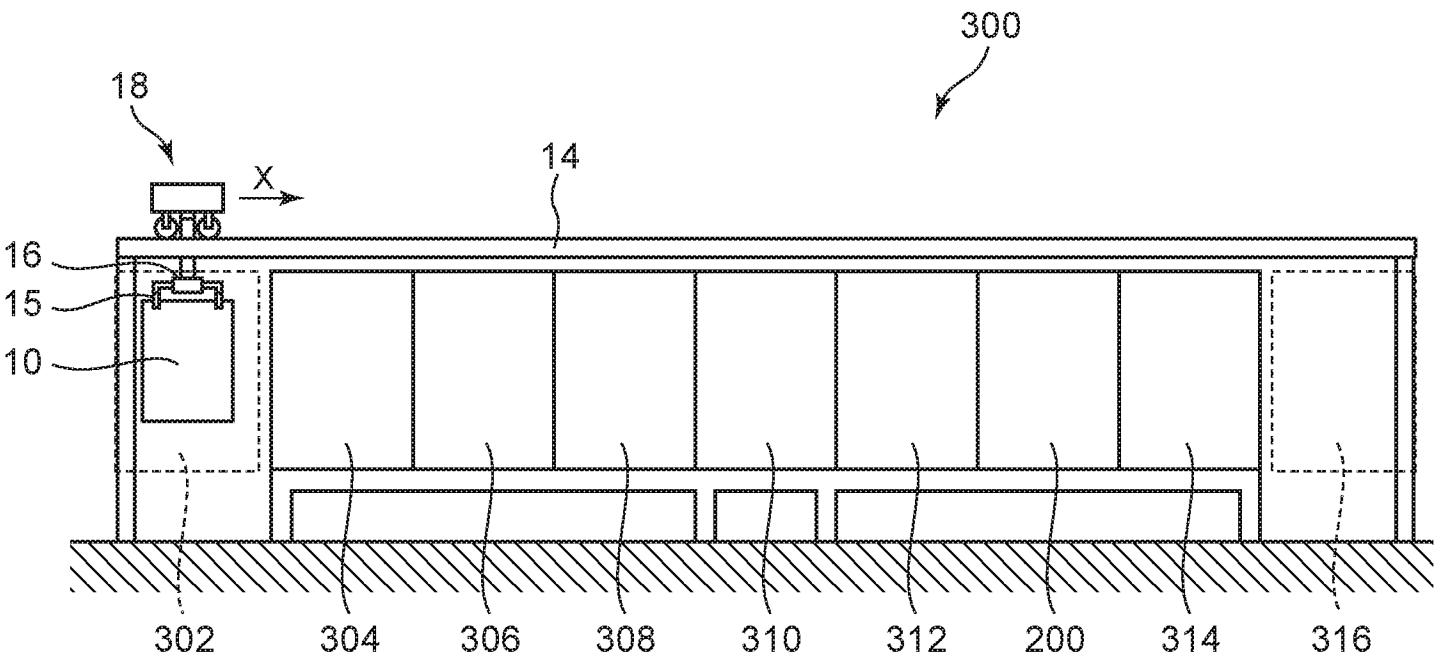
FIG. 2 is a side view of the surface treating apparatus 300 seen from alpha direction.

First, a structure of a surface treating apparatus 300 of the present invention will be described with reference to FIGS. 1 and 2. FIG. 1 is an arrangement plan of the surface treating apparatus 300 seen from above. FIG. 2 is a side view of the surface treating apparatus 300 shown in FIG. 1 seen from direction alpha. In FIG. 1, a transport hanger 16 and a transport mechanism 18 shown in FIG. 2 are omitted.

As shown in FIG. 1, along transport direction X of a plate-like work 10 (FIG. 2) as a treatment object, the surface treating apparatus 300 includes a load section 302, a 1st water-washing tank 304, a desmear tank 306, a 2nd water-washing tank 308, a pre-treatment tank 310, a 3rd water-washing tank 312, an electroless copper plating tank 200, a 2nd water-washing tank 314, and an unload section 316 arranged in sequence. Each process for electroless copper plating is performed in this order. Each tank has cutout(s) 8 (FIG. 1) forming a passage of transport hanger 16 shown in FIG. 2. In addition, each process will hereinafter be described in detail.

Further, the surface treating apparatus 300 includes the transport hanger 16 for transporting the plate-like work 10 in a horizontal direction which is clamped by clamps 15 (FIG. 2) and held vertically, and the transport mechanism 18 for transporting the transport hanger 16 into each tank. FIG. 2 indicates a state that plate-like work 10 is attached to the transport hanger 16 at a load section 302.

After the plate-like work 10 is attached at a load section 302, the transport mechanism 18 starts to move in the horizontal direction X, thereby the plate-like work 10 pass through inside of each tank (electroless copper plating tank 200, etc.). Eventually, the transport mechanism 18 stops at the unload section 316, and the plate-like work 10 that plating has been performed is detached from the transport hanger 16.

Figure 3:
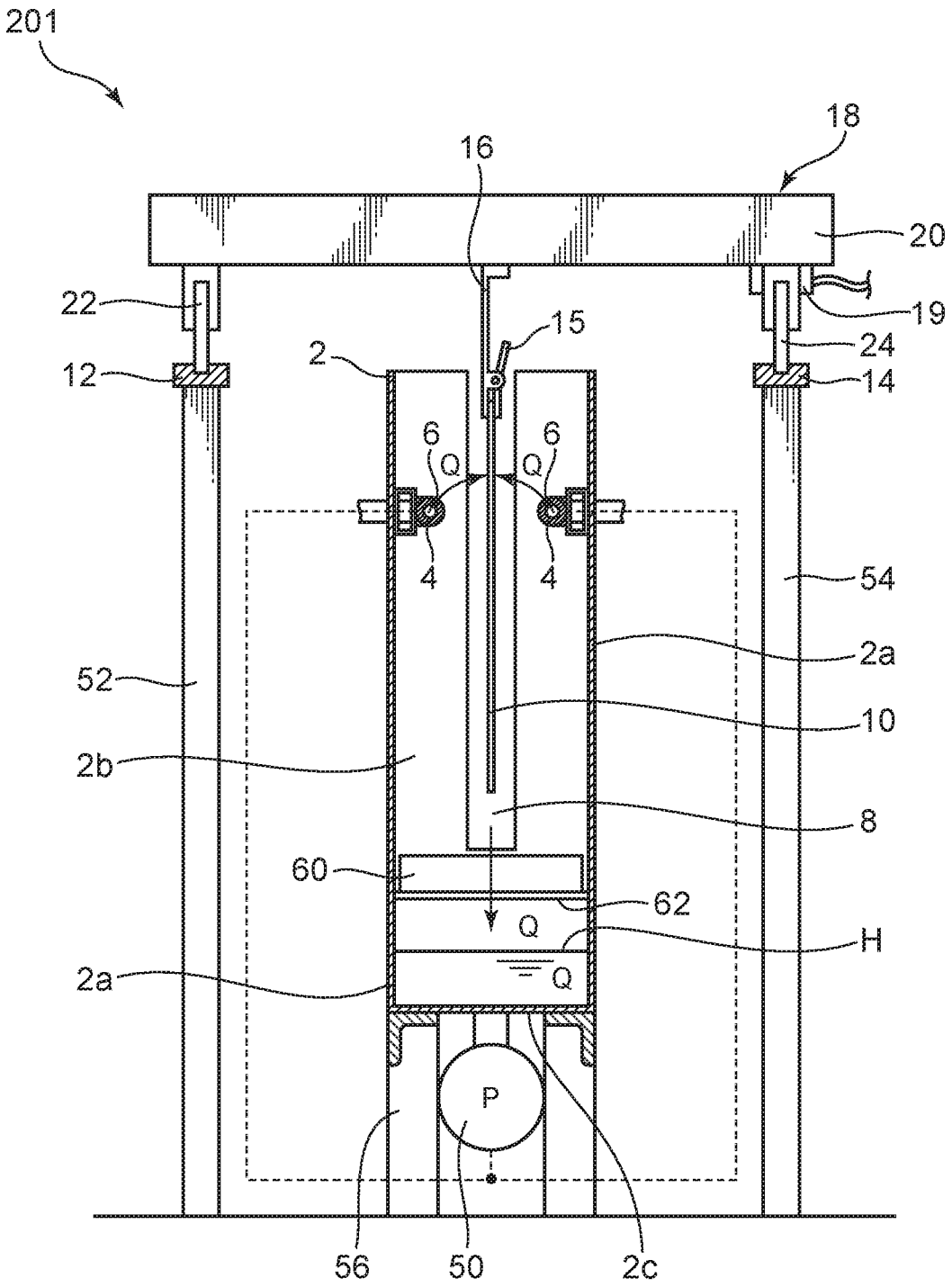
FIG. 3 is a cross-sectional view taken along the line beta-beta in FIG. 1 of an electroless copper plating tank 200 that forms a part of the surface treating apparatus 300.
Figure 4:
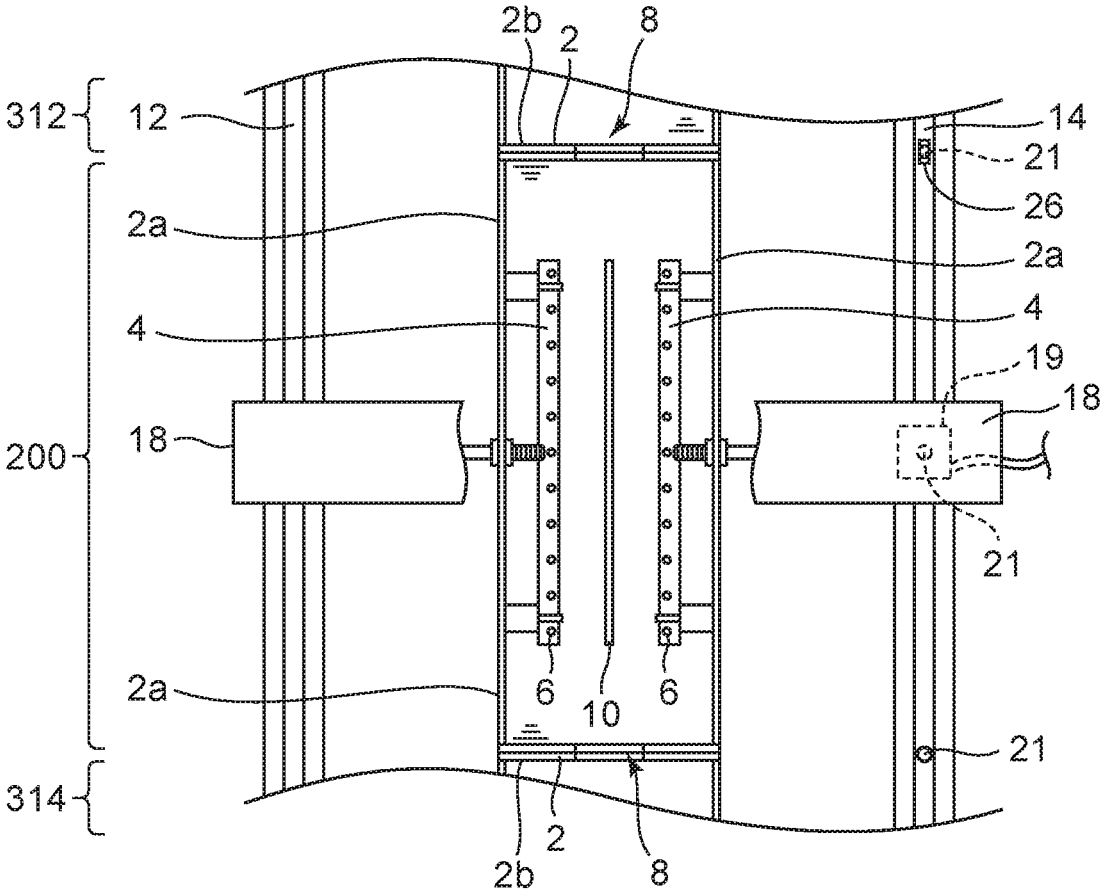
FIG. 4 is a view of the electroless copper plating tank 200 seen from above.

FIG. 3 is a cross-sectional view taken along the line beta-beta of the electroless copper plating tank 200 (FIG. 1) that forms a part of the surface treating apparatus 300. FIG. 4 is a view of the electroless copper plating tank 200 shown in FIG. 3 seen from above. The transport hanger 16 and the transport mechanism 18 are omitted in FIG. 4.

The electroless copper plating tank 200 shown in FIG. 3 includes a tank body 2 mounted on the frame 56 and a circulation pump 50 for circulating the processing solution Q (electroless copper plating solution) accumulated on the bottom in the tank body 2 by supplying with the liquid squirting part 4.

For performing a process on the plate-like work 10, a liquid squirting part 4 which has a squirt port 6 is arranged inside of each tank such as the electroless copper plating tank 200. As shown in FIG. 3, the processing solution is squirted from the squirt port 6 of the liquid squirting part 4 toward the plate-like work 10 obliquely upward to a horizontal plane.

Therefore, the processing solution Q (electroless copper plating solution) is attached to the upper side of the plate-like work 10 which is clamped by the transport hanger 16 inside of the tank body 2. Accordingly, it becomes possible to attach the processing solution Q to the surface of the plate-like work 10 while the processing solution Q is running down the plate-like work 10. In addition, the structure of the liquid squirting part 4 hereinafter be described in detail.

Thus, a system is employed that circulated processing solution Q runs down the plate-like work 10 without dipping the plate-like work 10 into stored processing solution Q. Therefore, it becomes possible to reduce the total amount of the processing solution Q used for the surface treating apparatus 300 in whole as compared with a dipping type.

The transport mechanism 18 includes the guide rails 12, 14, a support member 20, and the transport rollers 22, 24 shown in FIG. 3. At the bottom of the support member 20, the transport rollers 22, 24 are installed for movement of the transport mechanism 18 on the guide rails 12, 14. The transport rollers 22, 24 are powered by a motor (not shown). Each of guide rails 12, 14 are fixed on the frames 52, 54. As the plate-like work is transported in such a horizontal direction, there is no need to move up and down. Therefore, it becomes possible to save space because the height of apparatus can be lowered.

As shown in FIG. 3, the transport hanger 16 is fixed below the support member 20 so as to be suspended between two guide rails 12, 14. This makes it possible to reduce a vibration of the plate-like work 10, and also possible to reduce a distortion of structural objects (such as guide rails 12 and 14, frames 52 and 54, etc.) which support the transport mechanism 18.

Also, a plural of magnets 21 are embedded at a predetermined location on the guide rails 12, 14 shown in FIG. 4. The transport mechanism 18 has a magnetic sensor 19 for detecting the magnet 21 on the guide rails 12, 14. The magnetic sensor 19 is installed on the lower side of the support member 20 (one place of the guide rail 14's side).

This allows the transport hanger 16 transported into the electroless copper plating tank 200 to stop at a predetermined location (for example, at the center position of the electroless copper plating tank 200 shown in FIG. 4).

As shown in FIG. 3, the circulation pump 50 installed for each tank is connected to the bottom of the tank body 2, and between the tank body 2 and the liquid squirting part 4 are connected through the circulation pump 50 (indicated by the dotted arrow). This makes it possible to provide the liquid squirting part 4 with the processing solution Q accumulated in the bottom of the tank body 2 again by means of circulation pump 50.

The tank body 2 includes side walls 2*a*, 2*b* and bottom 2*c*, and is formed by assembling these materials such as PVC (polyvinyl chloride) with the use of processing, adhesion, etc., in one united body. The processing solution attached to the plate-like work 10 is received on a downward bottom 2*c* of the tank body 2. In addition, the tank body 2 of the same shape is also used for each tank shown in FIG. 1 other than the electroless copper plating tank 200. That is to say, the structure of each tank is the same, but the type of the processing solution (plating liquid, desmear liquid, washing water) used for each tank is different.

Also, a slit 8 as a cutout is formed so as to extend in a vertical direction on the side wall 2*b* of the tank body 2 shown in FIG. 3. This makes the plate-like work 10 possible to go through the slit 8 when the transport hanger 16 is transported. In addition, if the lower end 8*a* of the slit 8 is too low, the processing solution Q accumulated in the tank body 2 may be overflowed or flowing out.

Therefore, it is required to adjust the supplied amount of the processing solution Q so that the liquid level H (FIG. 3) of the processing solution Q accumulated in the tank body 2 is constantly placed at a position lower than lower end 8*a* of the slit 8. In this embodiment, such a problem is resolved by determining the amount of the processing solution Q so that the liquid level H (FIG. 3) of the processing solution Q accumulated in the tank body 2 is constantly placed at a position lower than lower end 8*a* of the slit 8, and by connecting the tank body 2 and the liquid squirting part 4 through a circulation pump 50.

[Structure of the Liquid Squirting Part 4]

Figure 5:
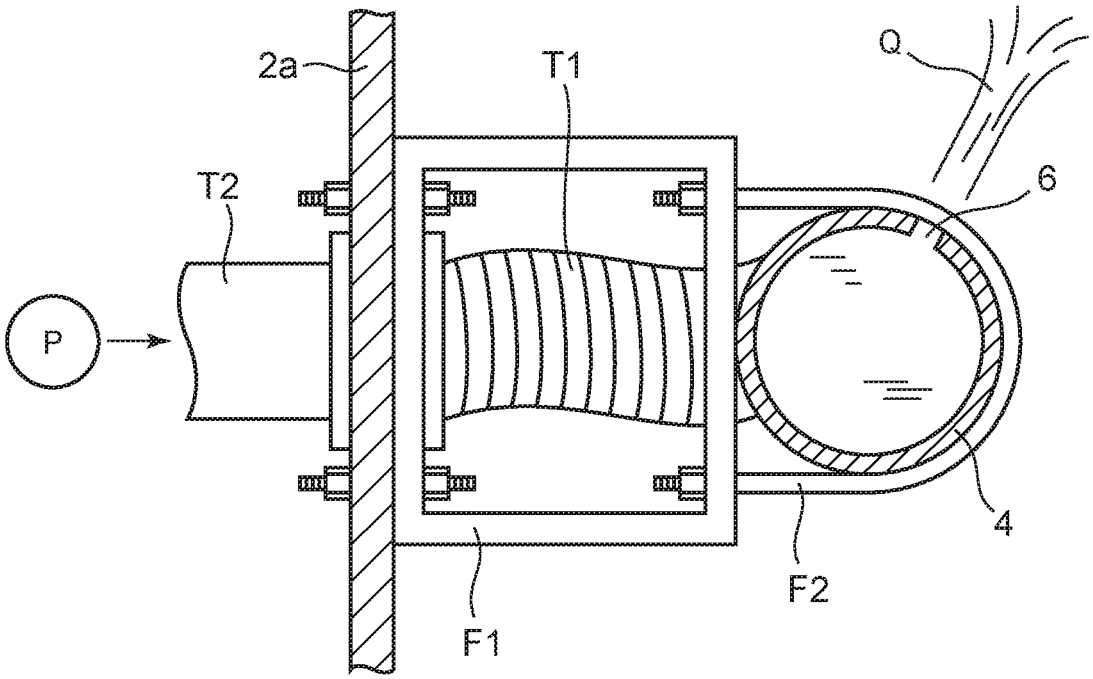
FIG. 5 shows a structure of a liquid squirting part 4.

FIG. 5 shows the structure of the liquid squirting part 4. FIG. 5 is an enlarged view of the liquid squirting part 4 shown in FIG. 3.

As shown in FIG. 5, the liquid squirting part 4 is installed on a base F1, which is configured by fixing a square pipe to the side wall 2*a*, by fastening with the use of two U-shaped fasteners F2. In this embodiment, the liquid squirting part 4 is fastened with the strength to be capable of manually rotating.

As shown in FIG. 4, the liquid squirting part 4 is comprised of a round pipe as a pipe member which has an internal space. Both sides of its longitudinal direction are sealed. Also, the squirt port 6 comprises a plural of holes disposed at predetermined intervals along a longitudinal direction. Further, a flexible pipe T1 and a pipework T2 are connected to the liquid squirting part 4. The flexible pipe T1 and the pipework T2 penetrates through the side wall 2*a* of the tank body. The pipework T2 is connected to a discharge port of the pump 50. Therefore, it is possible to squirt the processing solution Q fed from the pump 50 through the squirt port 6.

Figure 6B:
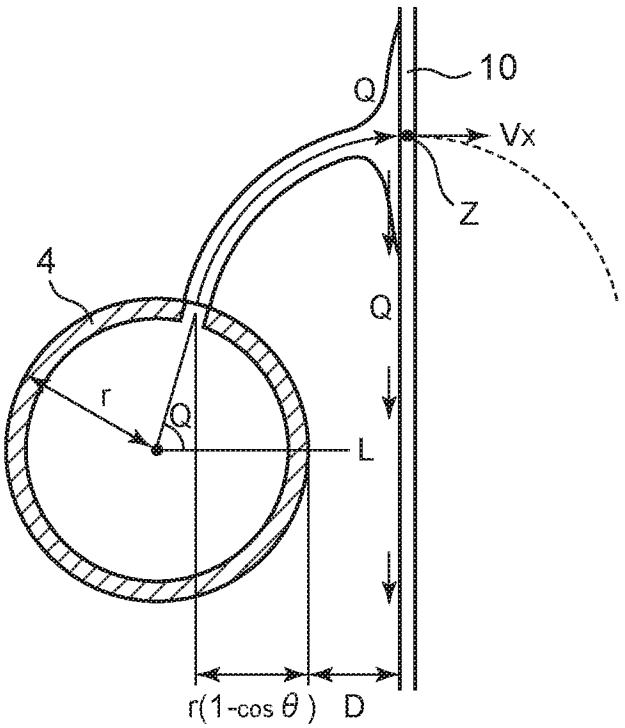
FIGS. 6A and 6B are figures showing a flow of a processing solution Q squirted from a squirt port 6 of the liquid squirting part 4.
Figure 6A:
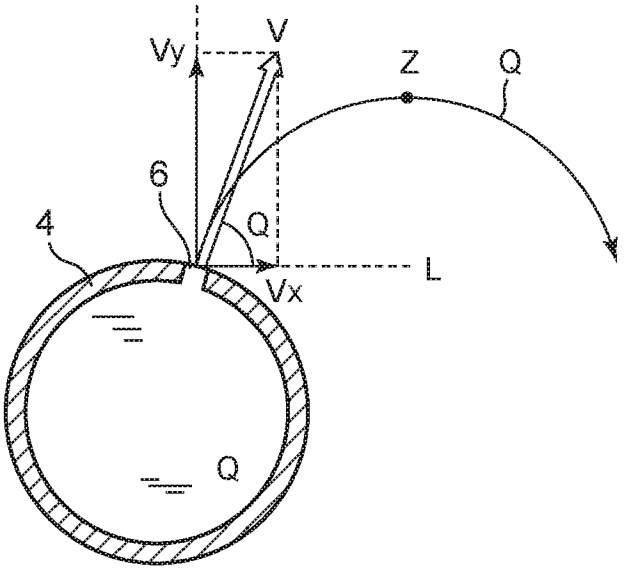

As shown in FIG. 6A, a squirt angle θ of the squirt port 6 is set obliquely upward to the horizontal plane L (for example, ranging from 5 degrees to 85 degrees). Therefore, a liquid current of the processing solution Q squirted from the squirt port 6 moves in a parabolic path. A position of a vertex Z can be determined from a squirt current velocity V and the squirt angle θ of the processing solution Q. In addition, the squirt current velocity V of the processing solution Q depends on the pressure from the pump 50 and the size of the squirt port 6.

In this embodiment, the squirt angle θ is designed so that the processing solution Q squirted at squirt current velocity V can hit against the plate-like work 10 at the vertex Z of the parabola under a condition that the liquid squirting part 4 (radius r) is separated at a predetermined distance D from the plate-like work 10. It becomes possible to inhibit bubbling at the vertex Z of the parabola shown in FIG. 6B. Because the vertical component of velocity Vy of the processing solution Q vanishes, and the horizontal component of velocity Vx (equal to the horizontal component of velocity when it is squirted) only remains.

In addition, as the liquid current hits perpendicular to a surface of the plate-like work 10, the processing solution Q attached to the plate-like work 10 spreads on the surface concentrically and uniformly. Further, it is possible to hit the vicinity of the vertex Z, i.e., forward or backward from the vertex Z by a predetermined distance.

If the processing solution Q is squirted in a horizontal direction or below than the horizontal direction without squirting obliquely upward to the horizontal plane L, the vertical component of velocity Vy of the processing solution Q continues to increase, and the synthesized velocity V also continues to increase by an amount corresponding to it. Accordingly, bubbles occur easily because the processing solution Q attached to the plate-like work 10 scatters in y direction.

As the mentioned above, the occurrence of bubbles when striking the work can be suppressed by squirting the processing solution obliquely upward to the horizontal plane L. This makes it possible to prevent from increasing the amount of the dissolved oxygen in the processing solution Q.

Figure 7:
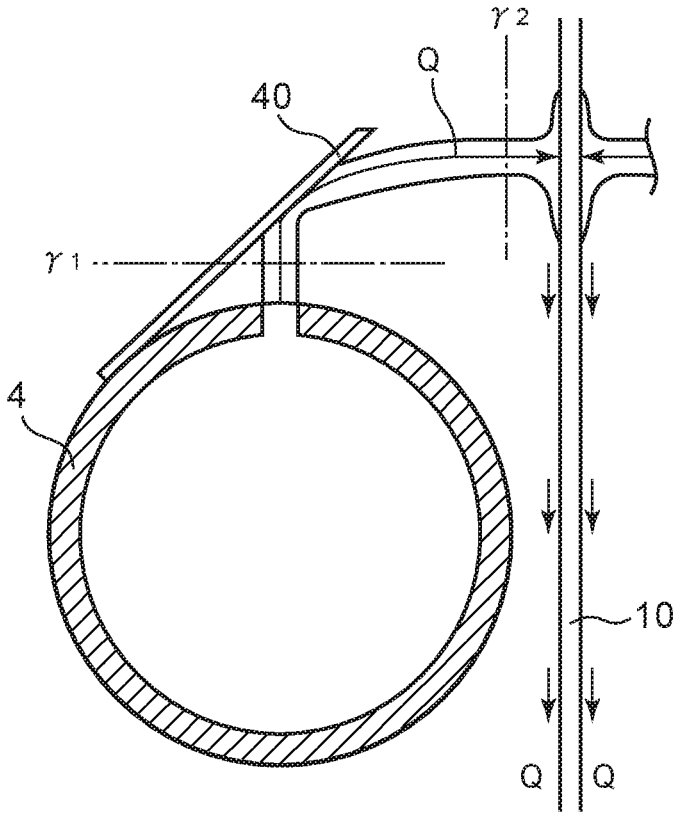
FIG. 7 shows an improvement example that a redirection member 40 is added to the liquid squirting part 4.

In addition, as shown in FIG. 7, a redirection member 40 may be attached to an outer periphery of the liquid squirting part 4 so as to overlap the squirt port 6 for changing the direction of the processing solution Q. Further, the redirection member 40 is spaced from the squirt port 6.

Figure 8A:
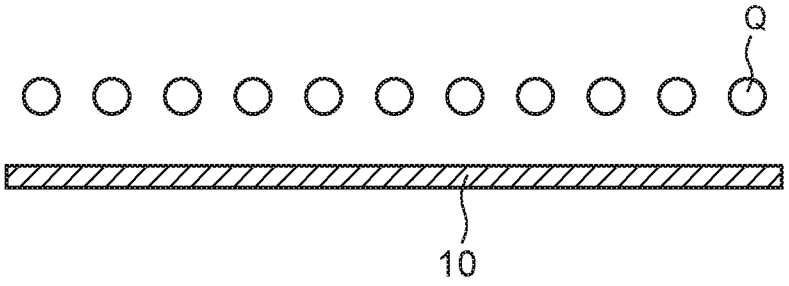
FIGS. 8A and 8B are cross-sectional views of a liquid flow of the processing solution Q before or after attaching to the redirection member 40.
Figure 8B:
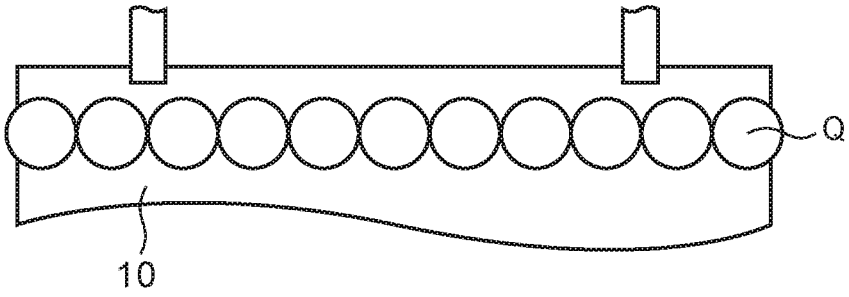

FIG. 7 is an enlarged view illustrating a state that the direction of squirted processing solution Q is redirected by a redirection member 40. FIG. 8A is gamma 1 cross-section view of squirted processing solution Q (before hitting on the redirection member 40). FIG. 8B is gamma 2 cross-section view of the processing solution Q after hitting on the redirection member 40).

If the redirection member 40 is used, the area of liquid flow (section area shown in FIG. 8A) becomes bigger as it hit the redirection member (FIG. 8). Therefore, the liquid flow from each of nearby squirt port 6 are combined (FIG. 8) when attaching to the plate-like work 10, thereby it is possible to uniformize the processing solution Q which is attached to the surface of the plate-like work 10.

That is to say, ideally, it is possible to uniformize the liquid flow like a liquid flow squirted through a slit (a long hole). Also, to describe a parabola as well as the liquid flow squirted through a slit (a long hole), the width of the slit is needed to be narrowed (Because, it is required to attain the same flow rate when squirting that an area of the slit is the same as the sum of area of holes). However, there is a disadvantage that it may be clogged easily. Therefore, holes are formed to achieve the same effect as a slit.

1.2 Each Processing in the Surface Treating Apparatus 300

Figure 9:
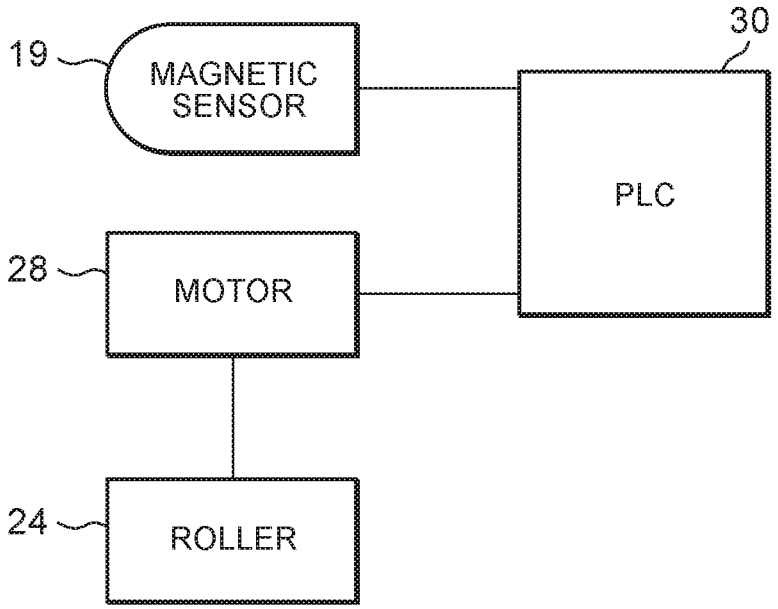
FIG. 9 shows a relation of connection for controlling moving motion of a transport mechanism 18.

Referring to FIG. 9 etc., each process of the surface treating apparatus 300 will described. In this embodiment, the processing solution Q used for each tank of the surface treating apparatus 300 is constantly circulated by the circulation pump 50 in each tank.

FIG. 9 shows a relation of connection for controlling transferring movement of the transport mechanism 18. As shown in FIG. 9, the magnetic sensor 19 (FIG. 4) is connected to a PLC 30, and detects that it is arrived above the magnet which is arranged on the guide rail 14. A signal that the magnetic sensor 19 has been detected is sent to the PLC 30. After receiving a signal, the PLC 30 controls movements (forward, backward, and stop, etc.) of the transport rollers 22, 24 by switching on/off the motor 28.

At first, at the load section 302 shown in FIG. 1, an operator or an installation device (not shown) attaches a plate-like work 10 to be plated to the transport hanger 16 (a state shown in FIG. 2).

Then, as the operator push a transport switch (not shown), the transport hanger 16 moves into the 1st water-washing tank 304 along the guide rails 12, 14. That is, the PLC 30 controls the transport rollers 22, 24 so as to move forward by switching on the motor 28.

Next, at the 1st water-washing tank 304, water-washing a process is performed by applying water to the plate-like work 10 from both sides. The transport hanger 16 stops at the 1st water-washing tank 304 for a predetermined time, then, moves into the desmear tank 306.

For example, after receiving a signal from the magnetic sensor 19 that indicates an arrival at the center of the water-washing tank 304, the PLC 30 controls the motor 28 so as to stop for one minute. Then, the PLC 30 controls the transport rollers 22, 24 so as to move forward by switching on the motor 28. Also, a similar control is performed at the 2nd water-washing tank 308, the 3rd water-washing tank 312, and the 4th water-washing tank 314.

At the desmear tank 306, the transport hanger 16 stops for a predetermined time (for example, 5 minutes), and desmear processing solution (swelling conditioner, resin etching solution, and neutralizing solution, etc.) is applied to the plate-like work 10 from both sides. Here, the desmear process is a process to remove smear (resin) which remains on the plate-like work 10 upon machining such as making a hole, etc.

For example, after receiving a signal from the magnetic sensor 19 that indicates an arrival at the center of the desmear tank 306, the PLC 30 controls the motor 28 so as to stop for five minutes. Then, the transport rollers 22, 24 move forward by switching on the motor 28. A similar process is performed at the pre-treatment tank 310.

Next, at the 2nd water-washing tank 308, water-washing process is performed by applying water to the plate-like work 10 from both sides. The transport hanger 16 stops at the 2nd water-washing tank 308 for a predetermined time (for example, 1 minute), then, moves into the pre-treatment tank 310.

At the pre-treatment tank 310, the transport hanger 16 stops for a predetermined time (for example, for 5 minutes), and the pre-treatment solution is applied to the plate-like work 10 from both sides.

Next, at the 3rd water-washing tank 312, water-washing process is performed by applying water to the plate-like work 10 from both sides. The transport hanger 16 stops at the 3rd water-washing tank 312 for a predetermined time (for example, 1 minute).

Then, until arriving at the electroless copper plating tank 200 (FIGS. 3 and 4), it repeats the back and forth movement a predetermined number of times as mentioned below. The processing solution Q may not be reached to the plate-like work 10 because air (bubble) remains there, if there are holes such as through holes, etc. on the plate-like work 10. Therefore, it is required to remove air (bubble) before performing an electroless copper plating process.

Figure 10:
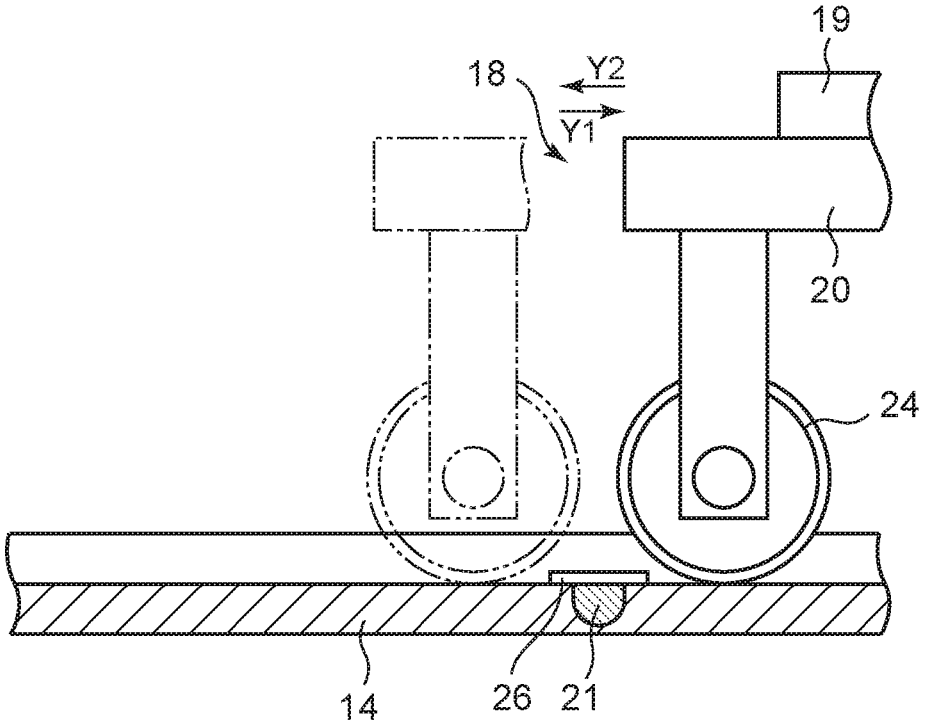
FIG. 10 shows a cross-section of a guide rail 4 between a 3rd water-washing tank 312 and the electroless copper plating tank 200.

FIG. 10 shows a cross-section surface of the guide rail 14 between the 3rd water-washing tank 312 and the electroless copper plating tank 200 (FIG. 1). As shown in FIGS. 9B and 1, one convex part 26 as an impact generator is formed on the guide rail 14. It is possible to drain off the processing solution Q by an impact caused when the transport roller 24 climbed over this convex part 26.

For example, after receiving a signal which indicates that the magnet 21 shown in FIG. 10 is arrived at the center (that is, the convex part 26 is climbed over by the transport roller 24), the PLC 30 controls the motor 28 so that the transport rollers 22, 24 move backward a predetermined distance (Y1 direction shown in FIG. 10). Then, the transport rollers 22, 24 move forward until detecting the magnet 21 (Y2 direction shown in FIG. 10). After repeating the above-mentioned back and forth movement a predetermined number of times (for example, 3 times back and forth), it stops at the center of the electroless copper plating tank 200 (FIG. 4).

The transport hanger 16 stops for a predetermined time in the electroless copper plating tank 200, and electroless copper plating solution is applied to the plate-like work 10 from both sides.

For example, the PLC 30 brings the motor 28 to a halt for 5 minutes after receiving a signal from the magnetic sensor 19 that indicates the arrival at the center of the electroless copper plating tank 200. Then, the transport rollers 22, 24 move forward by switching on the motor 28.

Then, at the 4th water-washing tank 314, a water-washing process is performed by applying water to the plate-like work 10 from both sides. The transport hanger 16 stops at the 4th water-washing tank 314 for a predetermined time (for example, 1 minute), after that, it is transferred to the unload section 316.

At last, the transport hanger 16 transferred to the unload section 316 stops. For example, the PLC 30 brings the motor 28 to a halt after receiving a signal from the magnetic sensor 19 that indicates the arrival at the unload section 316. After that, the plate-like work 10 is unloaded by the operator, etc. In this way, a series of the electroless plating process will be completed.

In the above embodiments, the surface treating apparatus 300 includes a plural of tanks (Such as the 1st water-washing tank 304, the desmear tank 306, the pre-treatment tank 310, and the electroless copper plating tank 200 shown in FIG. 1). However, the surface treating apparatus 300 may include at least any one tank of them.

In the above embodiments, electroless copper plating is performed on the plate-like work 10 in the surface treating apparatus 300. However, the other electroless plating may be performed on the plate-like work 10 (for example, electroless nickel plating, electroless tin plating, electroless gold plating, etc.).

Also, the configuration of the transport mechanism 18 is not limited.

1.3 Honeycomb Member

Figure 11A:
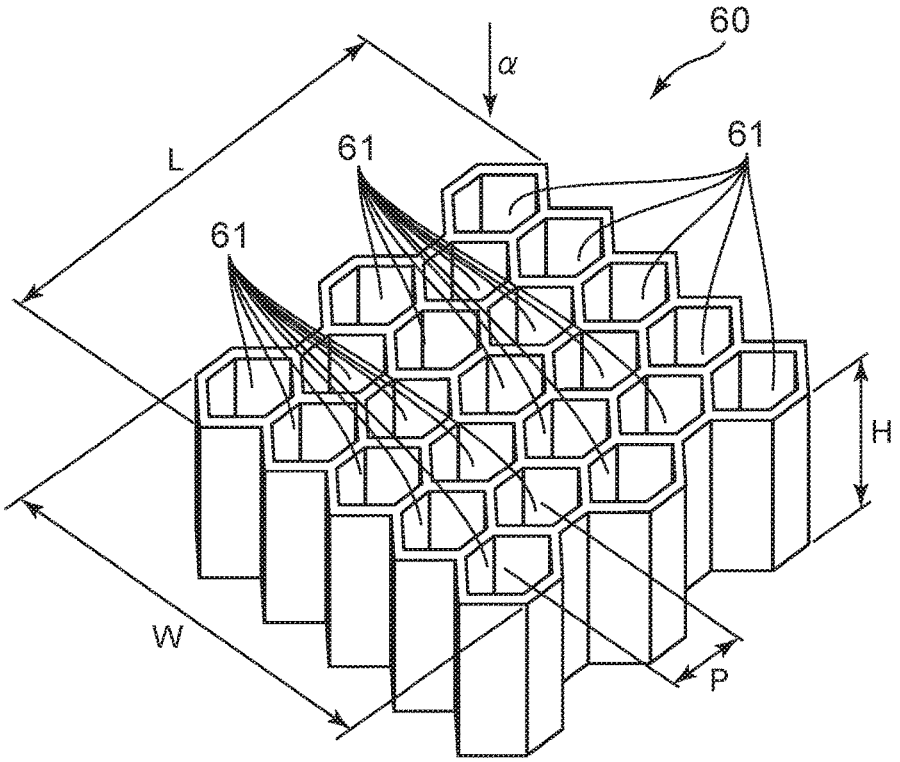
FIGS. 11A and 11B show details (a perspective view and an enlarged view of a main part) of a honeycomb member 60.
Figure 11B:
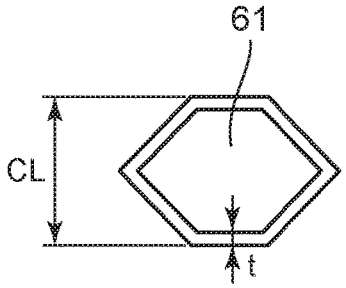
Figure 12A:
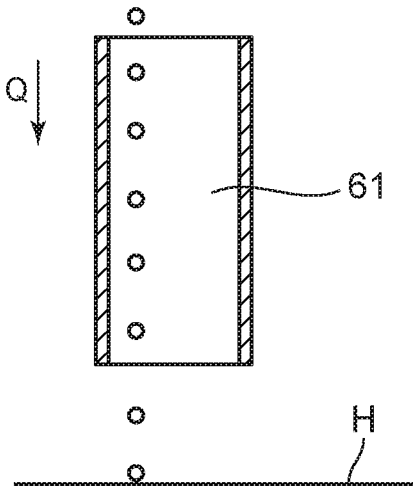
FIGS. 12A, 12B and 12C are diagrams for explaining relationship between droplets and reflection.
Figure 12B:
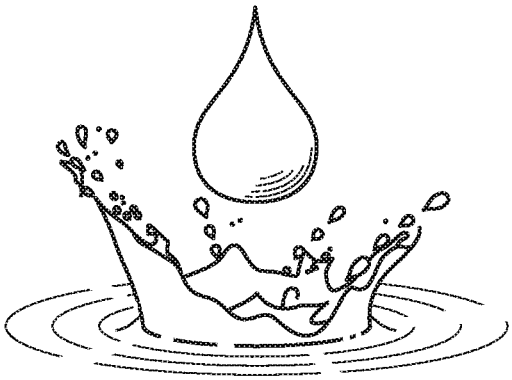

A honeycomb member 60 provided vertically below the transport hanger 16 will be described with reference to FIG. 11. The honeycomb member 60 consists of a plurality of tubular members with hexagonal holes connected together. Since the droplet of the processing solution falls in a vertical direction (a direction of an arrow $\alpha$), the droplet passes through a through-hole 61 (see FIG. 12A). As shown in FIG. 12B, the droplet that has passed through the through-hole 61 collides with the liquid level H, so that the shape of the droplet is crushed and a part of the droplet is reflected. At that time, a part of the droplet is reflected obliquely upward, and thus collides with an inner wall of the tubular member. As a result, the amount of droplets that reach higher than the upper surface of the through-hole 61 is reduced. Thus, due to the reflection by the inner wall, the honeycomb member 60 exhibits a scattering prevention function.

Figure 13A:
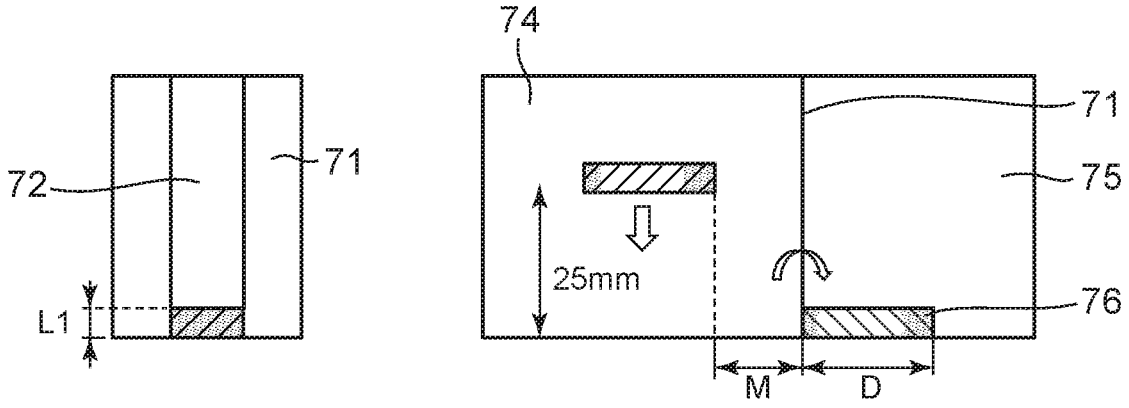
FIGS. 13A, 13B and 13C are diagrams showing conditions for a confirmation experiment of a scattering prevention effect.

A confirmation experiment of a scattering prevention effect by the honeycomb member 60 will be described with reference to FIG. 13. As shown in FIG. 13A, a side wall 71 having an opening 72 was provided between a first chamber 74 and a second chamber 75. At a position of an offset M away from the side wall 71 in the first chamber 74, water was supplied from a height of 750 mm toward a bottom plate of the first chamber 74 at a rate of 0.3 L/min/N.

A pallet 76 was installed adjacent to the side wall 71 of the second chamber 75, and water jumped out from the first chamber 74 to the second chamber 75 was collected and its amount was measured. In the present embodiment, the pallet 76 was configured to have 180 mm length D, 125 mm width W and 60 mm height H.

FIG. 14 shows measurement results when experimental conditions were changed. In Experiments 1 to 3, as shown in FIG. 13A, nothing was placed on a bottom surface. In these cases, the offset M was fixed to 180 mm and a height L1 (a height of a lower end of the opening 72) was set to 60 mm, 160 mm, and 260 mm. Accordingly, the amount of jumping out water was 330 mL per 30 minutes, 36 mL per 30 minutes, and 7 mL per 30 minutes respectively. As setting the height higher, the amount of jumping out water decreased.

In Experiments 4 and 5, the offset M was set to 100 mm, closer to the side wall 71 as compared with Experiment 1, to provide water therefrom. In these cases, the height L1 was set to 60 mm and 160 mm, and the amount of jumping out water was 330 mL per 30 minutes and 32 ml, per 30 minutes, respectively.

Experiments 1 to 5 show that the amount of jumping out water does not change when the offset M from the side wall 71 is increased to some extent, while the amount of jumping out water decreases when the height L1 is increased.

Figure 13B:
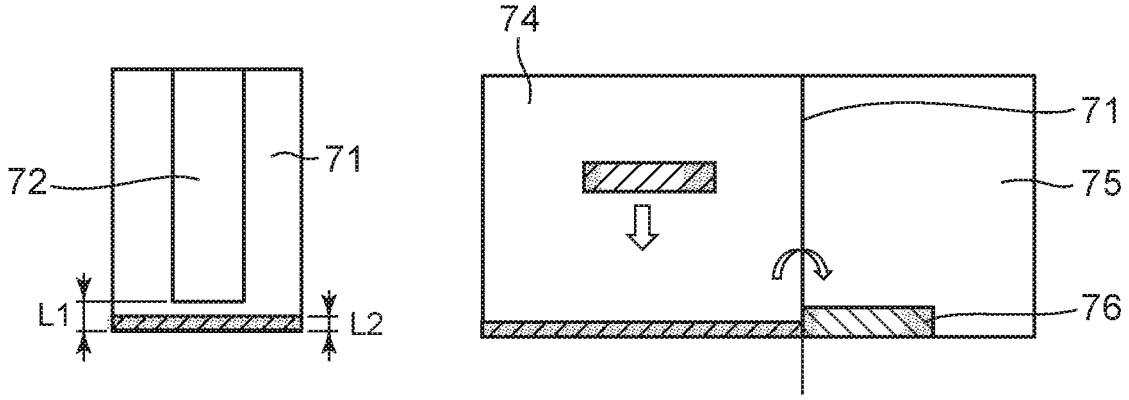

In Experiment 6, as shown in FIG. 13B, water as accumulated up to a depth of 20 mm on the bottom plate of the first chamber 74. All the other conditions were the same as those in Experiment 1. In this case, the amount of jumping out water was 100 mL per 30 minutes. Thus, by providing a water surface, the amount of jumping out water can be reduced to ⅓ or less without increasing the height L1. This is considered to be resulting from the reflection at the water surface as shown in FIG. 12B.

Figure 13C:
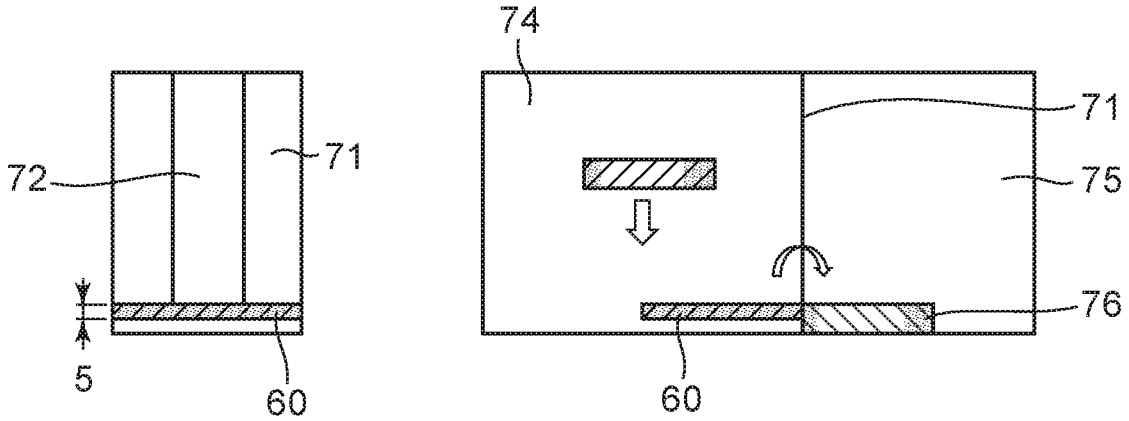

As shown in FIG. 13C, Experiments 7 and 8 are cases where a honeycomb member HC1 was installed so that the height of the upper surface of the honeycomb member HC1 was equal to the height L1. In the present embodiment, a honeycomb member with 530 mm length L (23 mm of pitch P), 350 mm of width W (12 mm of cell size CL), 55 mm of height H and 0.2 mm of thickness t (see FIG. 11) was used as the honeycomb member HC1. As is clear from the result of Experiments 7 and 8, the amount of jumping out water was 15 ml per 30 minutes, which is less than 1/20 of those of Experiments 1 and 4, regardless of the same height L1 (60 mm), the same offset M (180 mm or 100 mm).

Figure 12C:
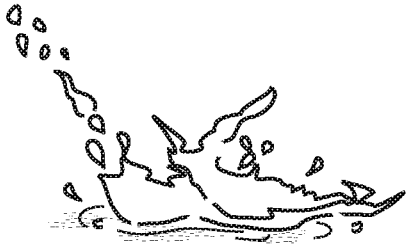

In Experiments 7 and 8, the droplet is reflected by the bottom surface. As shown in FIG. 12C, the droplet reflected by the bottom surface of the first chamber 74 is crushed and partially reflected as in the case of being reflected by the water surface. Then, a part of the reflected droplet is blocked by the inner wall of the honeycomb member 60.

Experiment 9 is a case where a honeycomb member HC2 was installed. The honeycomb member HC2 has 530 mm of length L (5.4 mm of pith P), 350 mm, of width W (3.3 mm of cell size CL), 55 mm of height H and 0.1 mm of thickness t. This is a case where the size of the through-hole 61 is smaller than those in Experiments 7 and 8. Even though the through-hole 61 was made smaller in this way, the amount of jumping out water was still reduced to about ¼ or less compared to Experiment 1. The amount of jumping out water in Experiment 9 was larger than that of Experiment 7 or 8 where the honeycomb member HC1 was used. An inventor understands this is because that, compared to the case using the honeycomb member HC1, in the case using the honeycomb member HC2, a surface area resulting from the thickness t becomes relatively larger compared to an exposed surface area of the through-hole 61, and some of the droplets are reflected by the upper surface of the honeycomb member HC2 without passing through the through-hole 61.

By installing the honeycomb member 60 described above, it becomes possible to provide a surface treatment apparatus with less splash even when the height to the opening of a side wall 2*b* is lowered. As a result, even with a compact surface treatment apparatus as a whole, the mixture of liquid into adjacent treatment chambers can be reduced.

1.4 Variation

In the above-described embodiment, the honeycomb member 60 having honeycomb structure is employed as a splash preventing part. However, the present invention is not limited to this, and it may employ a member having honeycomb-like structure where a plurality of polygonal or circular tubular members other than hexagonal tubular members are arranged as the honeycomb member 60, that is, a member with a shape having a plurality of vertically long individual tubular members that are arranged so that their openings are oriented to face a vertical direction. With such a structure, the droplet that entered from the upper surface of the individual tubular member passes through the through-hole and is reflected by the bottom surface and the like, then the reflected droplet that enters the individual tubular member again from the lower surface of the individual tubular member is reflected by the internal surface of the individual tubular member. Thus, it is possible to prevent the droplet from jumping out of the upper surface of the individual tubular member.

In the embodiment, as illustrated in FIG. 3, the surface treating apparatus that squirts the processing solution Q directly from the liquid squirting part 4 to the plate-like work 10 has been described. However, it may be a surface treating apparatus that squirts the processing solution Q indirectly to the plate-like work 10. That is, the present invention is applicable to the following surface treating apparatus.

A surface treating apparatus including:

a transport hanger for transporting a treatment object;

a tank body for attaching the processing solution interiorly to the treatment object which is transported by the transport hanger; and a transport mechanism for transporting the transport hanger into the tank body, in which the tank body includes a liquid receiving part to receive the processing solution applied to the treatment object, a liquid retention part that is provided above the liquid receiving part and retains the processing solution to be applied to the treatment object, and a liquid outflow part that is configured to have a tip protruding from a connecting part with the liquid retention part or a connecting part with the liquid receiving part to allow the processing solution overflowing and flowing down from the liquid retention part to flow out toward the treatment object.

In the present embodiment, a processing solution of different kind is applied to the treatment object in each treatment chamber. For example, when the first processing solution is a plating solution, if it is mixed with water which is an adjacent second processing solution, there is no particular problem in the second treatment chamber but the plating solution is reduced by the amount mixed into the second treatment chamber. Conversely, when the first processing solution is water, if it is mixed with the plating solution that is the adjacent second processing solution, the water is mixed in the plating solution in the second treatment chamber. Since the plating solution in which water is mixed is pumped up and sprayed again on the treatment object, functionality of the plating solution deteriorates accordingly.

As described above, when the first processing solution is mixed into the second processing solution side, or when the second processing solution is mixed into the first processing solution side, it is problematic in either case.

In addition, in the present embodiment, a liquid tank for the processing solution Q is provided under the plate-like work 10, but this is optional.

2. Second Embodiment

Figure 15:
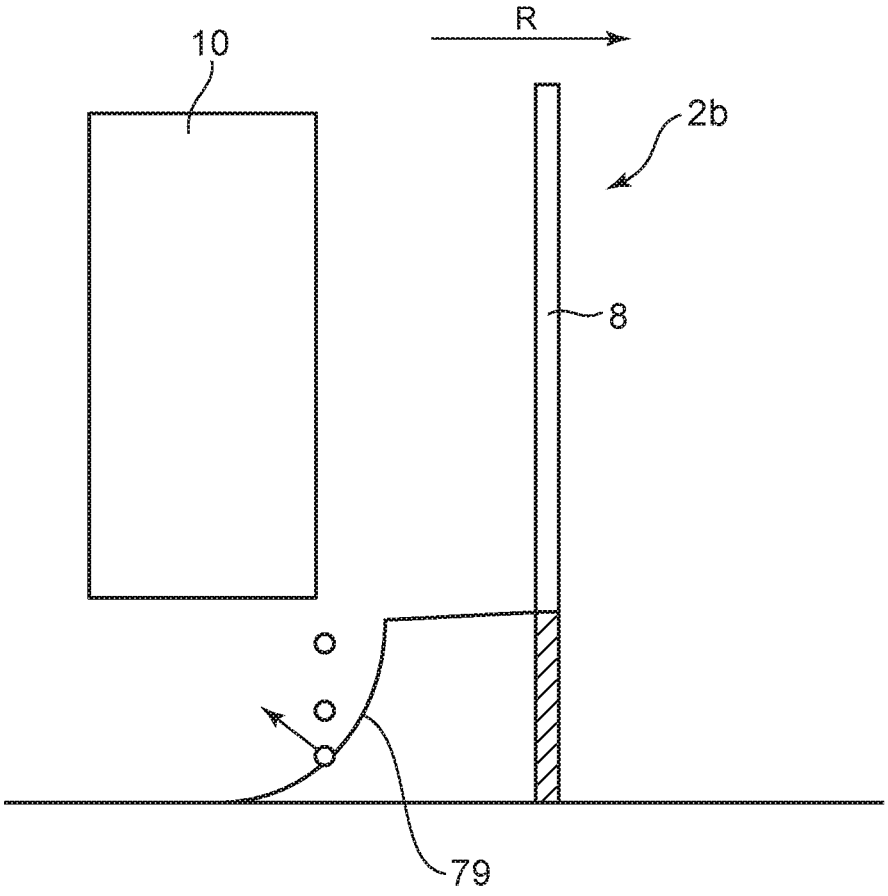
FIG. 15 is a diagram showing an example of a splashing direction converting part.

FIG. 15 shows the second embodiment. In the above-described embodiment, the splash preventing part that prevents the reflected droplet by the bottom surface from splashing into the adjacent treatment chamber is provided to prevent mixing into the adjacent treatment chamber. A splashing direction converting part 79 as shown in FIG. 15 may be provided so as to let the droplet bounces away from the opening of the side wall 2*b* when the droplet splashes. By controlling a direction in which the droplet splashes, the amount of splash toward the adjacent treatment chamber can be reduced. In FIG. 15, the splashing direction converting part has a curved shape in which the height in a vertical direction increases as it approaches a carry-in opening 8, but it may have a straight shape. In other words, a splashing direction converting part with any shape that increases its height in the vertical direction as it approaches the carry-in opening 8 may be used.

3. Third Embodiment

Figure 16:
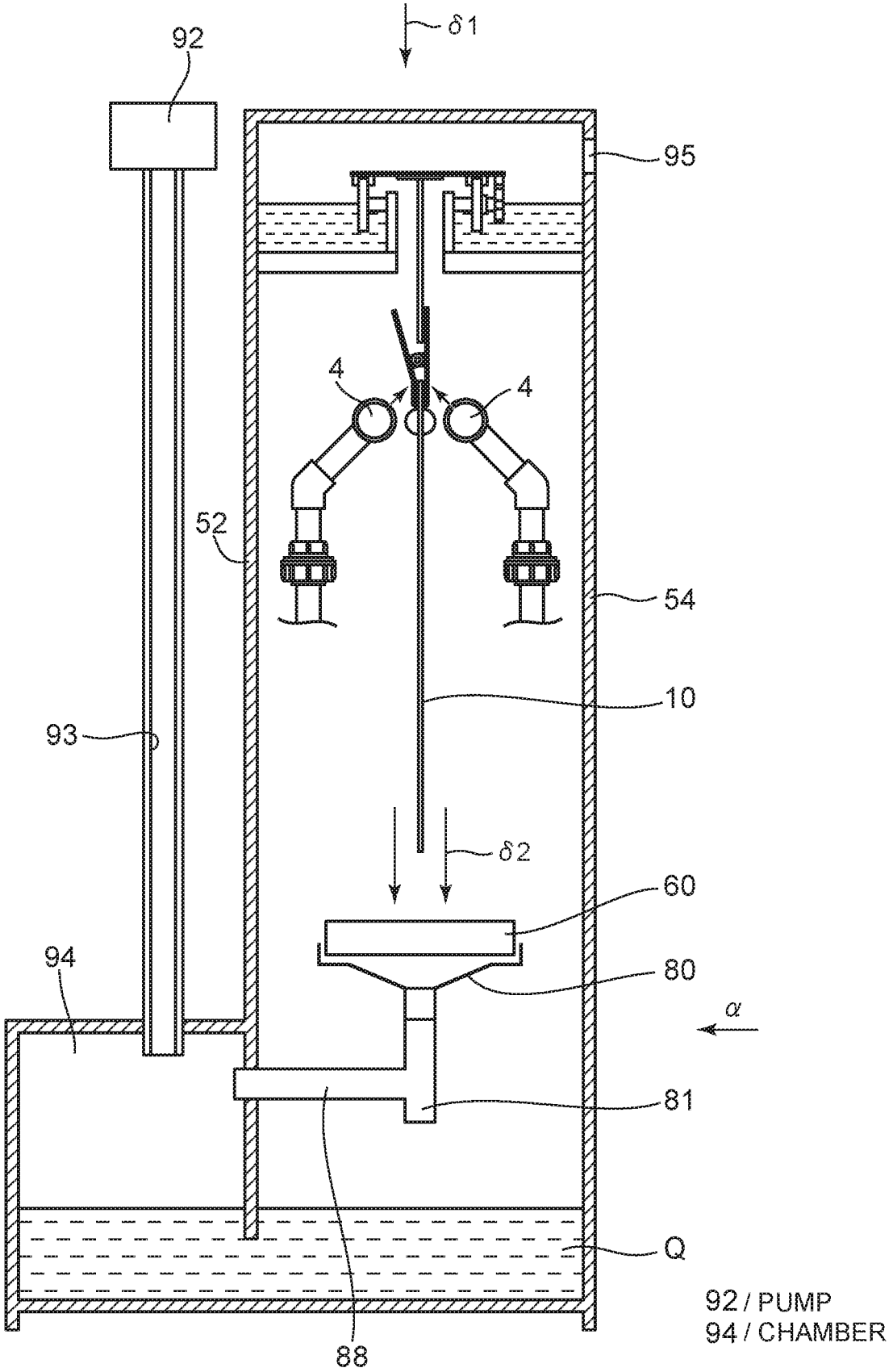
FIG. 16 is a front view of a third embodiment.

FIG. 16 shows the third embodiment. In this embodiment, a flow rate control mechanism is provided to reduce the amount of splash of the droplets that bounce on the surface of the honeycomb member 60 by flowing the air in the treatment chamber downwards. As will be described later, the flow rate control mechanism reduces the amount of jumping out liquid by sucking the air and the liquid downwards.

Figure 17:
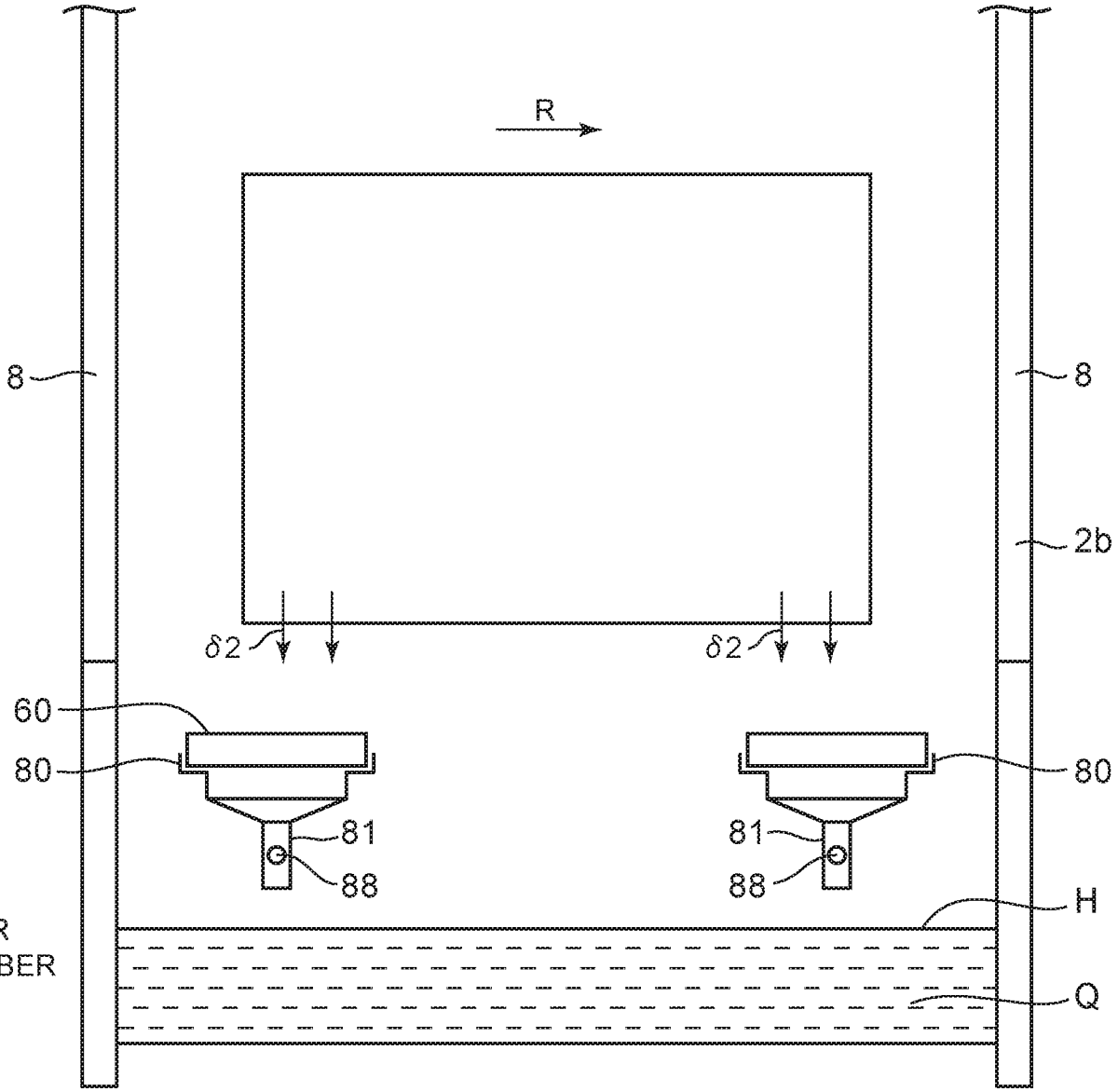
FIG. 17 is a diagram showing positional relationship between a plate-like work 10 and a tray 80 as viewed from the direction of an arrow alpha in FIG. 16.

In the present embodiment, as the flow rate control mechanism, a tray 80 having a shape as shown in FIG. 16 is provided under the honeycomb member 60 to control an air flow. FIG. 17 is a view as seen from the direction of an arrow alpha in FIG. 16. In FIG. 17, for ease of understanding, a frame 54 is not illustrated. As shown in FIG. 17, two trays 80 are provided under the plate-like work 10 in the vicinity of each slit 8. This is to reduce the amount of jumping out liquid to the adjacent treatment chamber in the vicinity of the slit 8.

Figure 18:
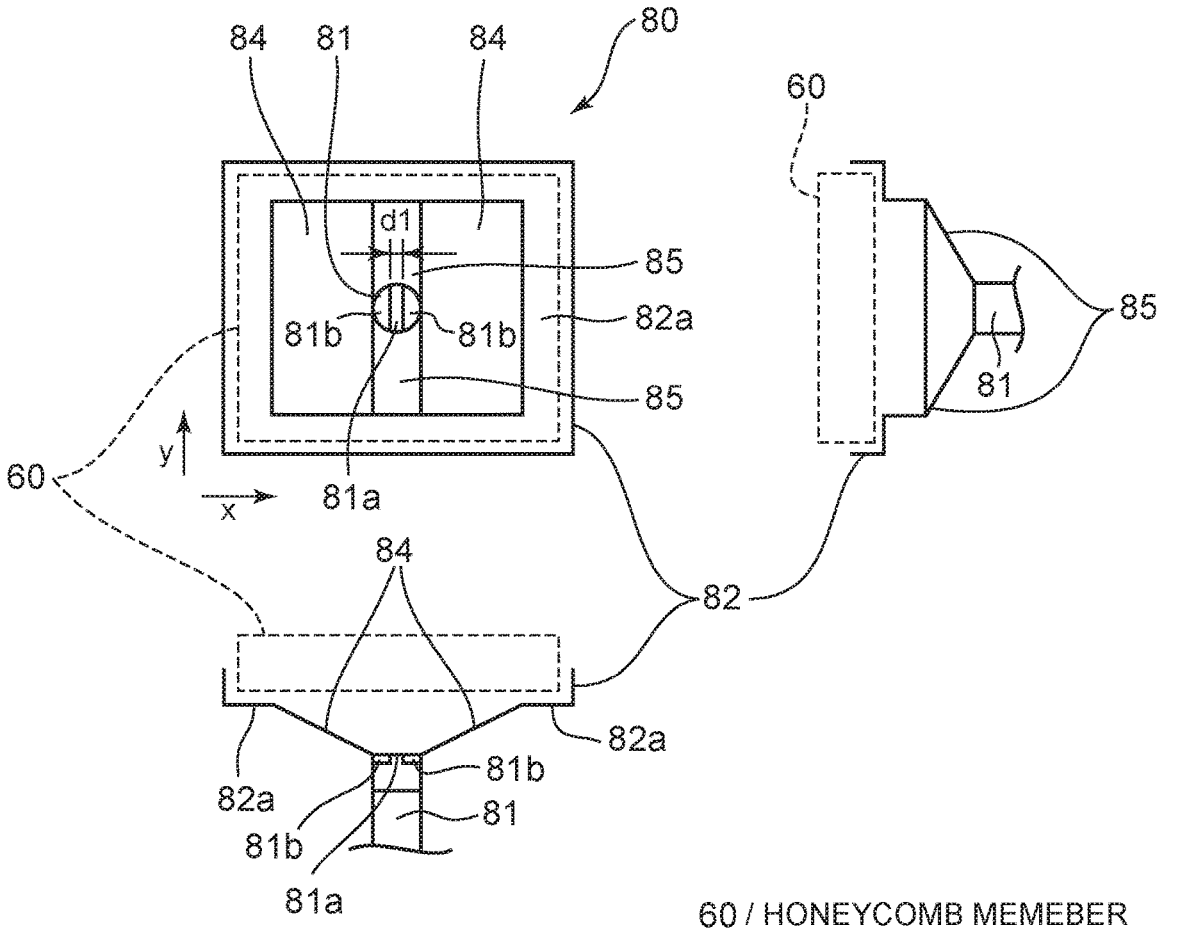
FIG. 18 is a diagram showing details of the tray 80.

The shape of the tray 80 will be described with reference to FIG. 18. In FIG. 18, for ease of explanation, the relative position of the honeycomb member 60 is shown by a broken line. A flat surface 82*a* is formed continuously at a lower end of a frame 82. A slope 84 is formed in the x direction from an inner end of the flat surface 82*a*. A slope 85 is formed in they direction from an end of the slope 84. In addition, a pair of lids 81*b* are fitted to an upper edge of a vertical pipe member 81 so that a slit 81*a* is formed.

In the present embodiment, a width d1 of the slit 81*a* is about 2 mm. Such width may be determined so that an allowable amount (determined by the inner diameter of the vertical pipe member 81) that the vertical pipe member 81 can suck per unit time becomes larger than an amount of liquid collected by the tray 80 per unit time. However, if the width d1 is made too large, flow velocity decreases when the suction air flow rate (amount Q=opening area A*flow velocity V) remains constant, so it is desirable to set the width d1 to 5 mm or less.

Figure 19:
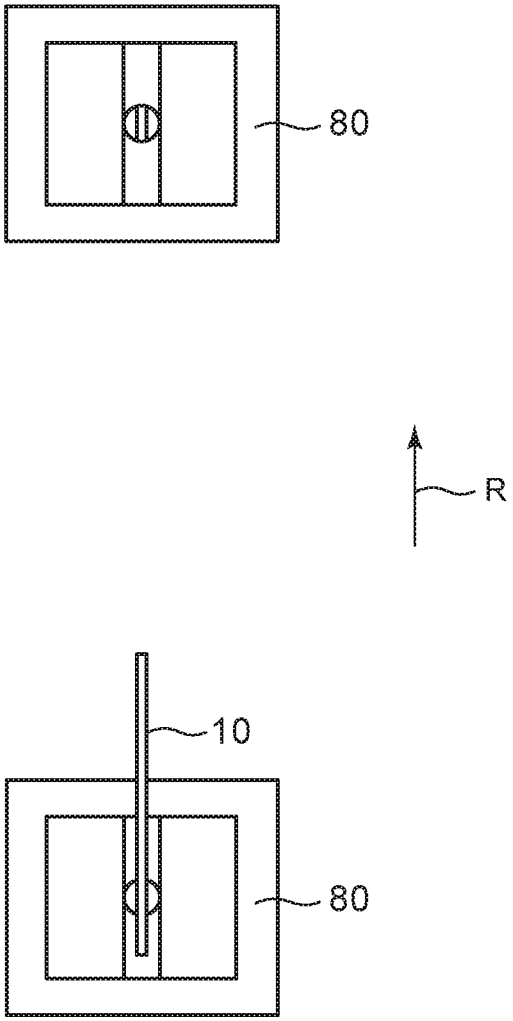
FIG. 19 is a diagram showing the positional relationship between the plate-like work 10 and the tray 80 as viewed from the direction of an arrow delta 1 in FIG. 16.

FIG. 19 shows an arrow view from a direction of an arrow delta 1 in FIG. 16. When viewed from above, the tray 80 is arranged such that the slopes 84 are located on both sides of the plate-like work 10 and the direction of a groove formed by the lower ends of the two slopes 84 is parallel to the plate-like work 10.

A vertical pipe member 81 is connected to the lower end of the slope 85. As shown in FIG. 16, a horizontal pipe member 88 is connected to a middle of the vertical pipe member 81 so as to communicate therewith.

Thereby, the liquid that has passed through the through-hole 61 of the honeycomb member 60 passes through the slopes 84 and 85 and is collected in the vertical pipe member 81. In the present embodiment, suction is performed by a pump 92 provided at a tip of a pipe 93 so that a chamber 94 is kept in a negative pressure state.

An air intake 95 is provided in the upper part of the treatment chamber. Therefore, the air taken in from the air intake 95 by the suction flows from the through-holes 61 of the honeycomb member 60 through the slopes 84 and 85 to the vertical pipe member 81 and the horizontal pipe member 88. Then, together with the collected liquid, the air is discharged from the horizontal pipe member 88 to the chamber 94.

As is shown in FIG. 19, the tray 80 is arranged such that the slopes 84 are located on both sides of the plate-like work 10 and the direction of the groove formed by the lower ends of the two slopes 84 is parallel to the plate-like work 10. Therefore, when sucked by the pump 92, an air flow in a direction of an arrow delta 2 is generated as shown in FIG. 16. As the air flow in the direction of the arrow delta 2 is generated at the lower part of the plate-like work 10, the air flow also contributes to stabilize the posture of the thin plate-like work 10.

In this embodiment, the tray 80 is provided under the honeycomb member 60, but a member other than the honeycomb member 60 may be used. Also, the tray 80 may be provided without the honeycomb member 60. Even in this case, the air flow due to the suction can prevent the droplets from splashing.

Moreover, as a flow rate control mechanism, a device with a shape other than that of the tray 80 may be employed. That is, any flow rate control mechanism that can reduce the amount of splash of the droplets splashed on the surface of the honeycomb member 60 by flowing the air in the treatment chamber downwards may be used.

In the present embodiment, controlled air velocity in the treatment chamber is kept to be from 0.2 to 0.5 m/s by adjusting the suction by the pump 92. By setting the air velocity to this extent, the splash on the surface of the honeycomb member 60 can be reduced while stabilizing the posture of the plate-like work 10.

In the present embodiment, the tray 80 under the honeycomb member 60 is formed to have a shape with inclined surfaces. Therefore, the droplet that has passed through the honeycomb member 60 splashes obliquely, the splashed droplet is prevented from passing through the through-hole 61.

In the present embodiment, the slit 81*a* is formed by the pair of lids 81*b*, but other methods such as adopting a pipe which is partly formed to have the shape of the slit 81*a* may be used.

Figure 20A:
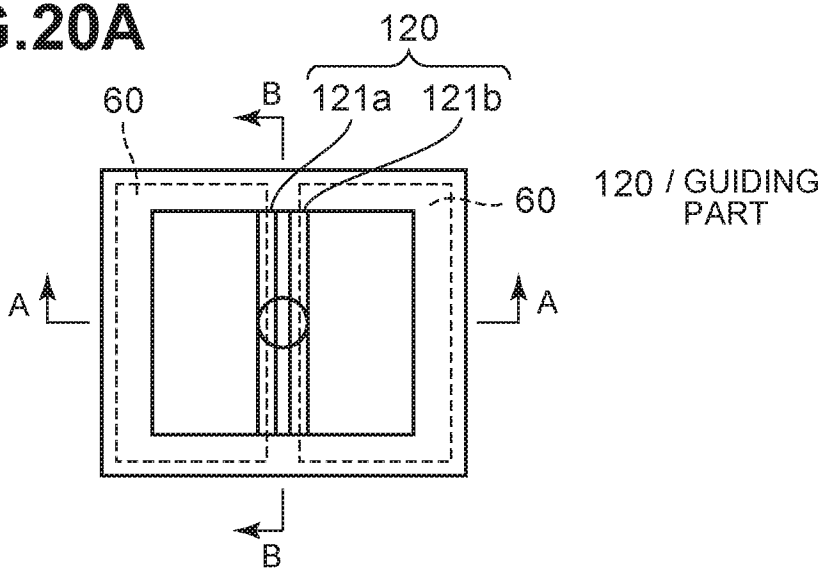
FIGS. 20A, 20B, 20C and 20D are diagrams illustrating an embodiment in which a guiding part 120 is provided.
Figure 20B:
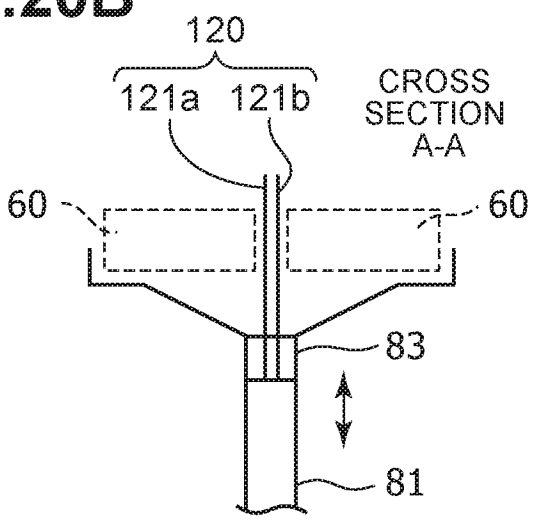
Figure 20C:
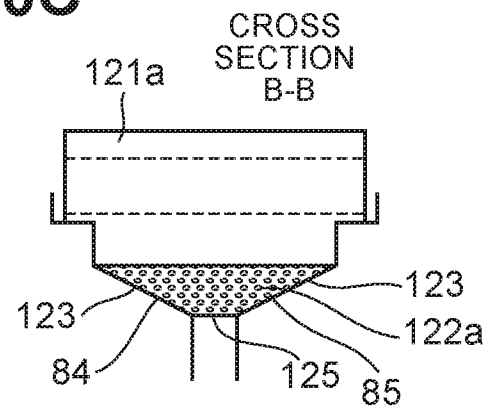
Figure 20D:
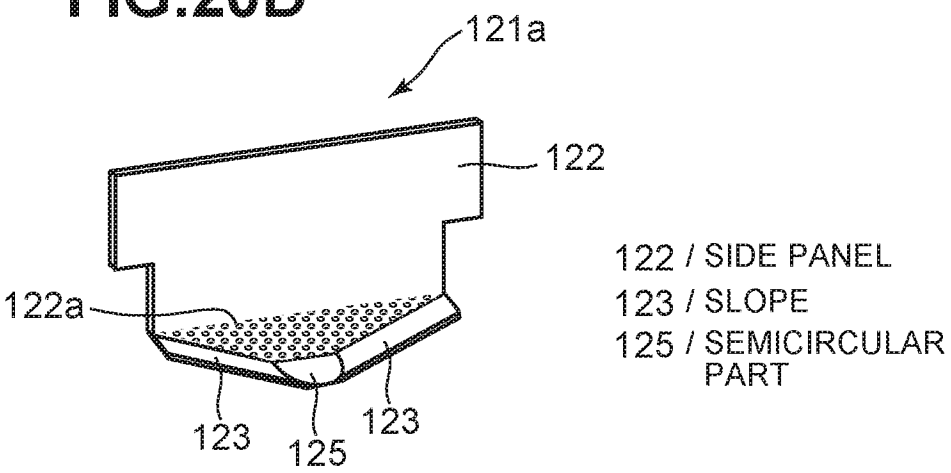

FIG. 20A shows an embodiment in which a guiding part 120 for air suction is provided. A cross section A-A and a cross section B-B in FIG. 20A are shown in FIGS. 20B and 20C respectively. The guiding part 120 is composed of lids 121*a* and 121*b*. A perspective view of the lid 121*a* is shown in FIG. 20D. The lid 121*a* has a side panel 122, slopes 123, and a semicircular part 125. The side panel 122 is provided with a plurality of through-holes 122*a*. The lid 121*b* is symmetrical with the lid 121*a*.

By mounting the lids 121*a* and 121*b* on the tray 80, the slopes 84 and 85 and the slopes 123 are combined and held together, and the vertical pipe member 81 is partially blocked by the semicircular part 125. Also, the honeycomb member 60 is divided into two, and a gap having the width d1 between the side panels 122 is formed on the vertical pipe member 81. Thereby, since a suction port can be located closer to the plate-like work 10, suction force can be enhanced. Moreover, since the suction port can be narrowed, the flow velocity of the air below the plate-like work 10 can be increased. Thereby, the splash of droplets can be reduced.

Note that the problem of droplets being accumulated in the tray 80 by the lids 121*a* and 121*b* can be solved by providing the through-holes 122*a*. A position and number of the through-holes 122*a* may be designed according to the amount of the liquid accumulated in the tray 80.

In FIG. 20, the lids 121*a* and 121*b* having the side panels 122 are adopted. However, if a holding mechanism is provided separately, the slopes 123 are not essential. Further, the side panels 122 may be omitted. Even in this case, since the suction port can be narrowed by lids formed only of the semicircular parts 125, the flow velocity of the air below the plate-like work 10 can be increased.

Depending on the shape of the plate-like work 10, a distance between the plate-like work 10 and the tray 80 may vary. In this case, as shown in FIG. 20B, the tray 80 may be configured to be slidable in the vertical direction. For this height adjustment, a pipe member 83 having an outer diameter nearly equal to the inner diameter of the vertical pipe member 81 may be provided at the lower portion of the tray 80, or a bellows structure may be used. A well-known mechanism may be employed as a mechanism for slidably holding the height of the tray 80.

Note that the controlled air velocity in the treatment chamber is not limited to the above-described range.

The air intake 95 and the pump 92 may be provided in each treatment chamber. Accordingly, there remains almost no air flow in a direction of an arrow R in FIG. 17 (air flow toward the opening 8) in the treatment chamber, and the air flow is oriented substantially vertically, so that the posture of the plate-like work 10 is stabilized.

Further, a lower end surface of the frame 52 is located lower than the processing solution Q. Therefore, communication of air to the chamber 94 is performed through the vertical pipe member 81 and the horizontal pipe member 88.

In this embodiment, the case where the processing solution Q is used is described. However, the same structure can be also applied to the case of a water-washing tank (see FIG. 1) which performs water washing.

Note that the shape of the tray 80 is not limited to the above.

In the present embodiment, the flow rate control mechanism is employed to reduce the splash, but the flow rate control mechanism may be employed only for posture stabilization.

In this case, the apparatus according to the third embodiment can be understood as an apparatus having the following inventive concept.

A surface treating apparatus including:

a first treatment chamber in which a sheet-like treatment object is carried in a vertically held state;

a first processing solution flow down mechanism, provided in the first treatment chamber, for squirting a first processing solution to flow down from the upper portion of the carried treatment object over a surface region of the vertically held treatment object;

a second treatment chamber adjacent to the first treatment chamber in which the treatment object is carried in a vertically held state;

a second processing solution flow down mechanism, provided in the second treatment chamber, for squirting a second processing solution to flow down from the upper portion of the carried treatment object over a surface region of the vertically held treatment object;

a partition wall, provided between the first treatment chamber and the second treatment chamber, having a carry-in opening that enables the treatment object to be carried in through the carry-in opening in a vertically held state; and a mixing reduction mechanism, provided in the first treatment chamber or the second treatment chamber in the vicinity of the partition wall, for reducing the amount of the splashed processing solution that flowed down from the lower portion of the treatment object and has been reflected by a landing surface being mixed into the adjacent treatment chamber through the carry-in opening, in which the mixing reduction mechanism has an air flow rate control mechanism that controls air to flow in a vertical direction along the two planes of the sheet-like treatment object.

In this invention, since the flow velocity of air is increased by providing the guiding part 120 as shown in FIG. 20, the effect of stabilizing the posture of the plate-like work 10 is also achieved.

In the surface treating apparatus according to the present invention, a shape arranged by a plurality of the vertically long individual tubular members is a honeycomb-like shape. Thereby, the processing solution collides with the inner walls of the vertically long individual tubular members having the honeycomb-like shape and falls toward the landing surface.

In the surface treating apparatus according to the present invention, the honeycomb-like shape is a honeycomb shape. Thereby, the processing solution collides with the inner walls of the vertically long individual tubular members having the honeycomb shape and falls toward the landing surface.

The surface treating apparatus according to the present invention further includes a first processing solution collecting mechanism that collects the first processing solution falling from the lower portion of the treatment object to be fed to the first processing solution flow down mechanism or a second processing solution collecting mechanism that collects the second processing solution falling from the lower portion of the treatment object to be fed to the second processing solution flow down mechanism. This makes it possible to reduce the presence of different processing solution being mixed into the processing solution that is collected and used.

The surface treating apparatus according to the present invention includes a first processing solution storing part with an exposed liquid surface that stores the first processing solution falling from the lower portion of the treatment object below the treatment object in the first treatment chamber, in which a gap is provided between the liquid surface and a lower surface of the mixing reduction mechanism. This makes it possible to reduce the amount of scattering from the surface of the first processing solution.

In the surface treating apparatus according to the present invention, the first processing solution flow down mechanism pumps up the first processing solution stored in the first processing solution storing part and squirts the first processing solution toward the treatment object to flow down. This makes it possible to reduce the presence of the second processing solution being mixed into the first processing solution that is collected and used.

The surface treating apparatus according to the present invention further includes an air flow rate control mechanism for controlling an air flow so that the processing solution splashing on the landing surface is pulled back in the vertical direction. This makes it possible to reduce a splash on the landing surface.

In the surface treating apparatus according to the present invention, the treatment object has a sheet-like shape and the air flow rate control mechanism has a horizontally long opening with respect to a direction of carry-in toward the sheet-like treatment object, in which air is sucked from the opening. This makes it possible to reduce the splash on the landing surface by the air flow.

The surface treating apparatus according to the present invention includes: a first treatment chamber in which a sheet-like treatment object is carried in a vertically held state; a first processing solution flow down mechanism, provided in the first treatment chamber, for squirting a first processing solution to flow down from an upper portion of the carried treatment object over a surface region of the vertically held treatment object; a second treatment chamber adjacent to the first treatment chamber in which the treatment object is carried in a vertically held state; a second processing solution flow down mechanism, provided in the second treatment chamber, for squirting a second processing solution to flow down from the upper portion of the carried treatment object over a surface region of the vertically held treatment object; a partition wall, provided between the first treatment chamber and the second treatment chamber, having a carry-in opening that enables the treatment object to be carried in through the carry-in opening in the vertically held state; and a mixing reduction mechanism, provided in the first treatment chamber or the second treatment chamber in a vicinity of the partition wall, for reducing an amount of the splashed processing solution that flowed down from a lower portion of the treatment object and has been reflected by a landing surface being mixed into the adjacent treatment chamber through the carry-in opening, in which the mixing reduction mechanism reduces the amount of the processing solution splashing on the landing surface by controlling air to flow in a vertical direction along the two planes of the sheet-like treatment object.

Accordingly, it is possible to reduce the amount of the processing solution splashing on the landing surface due to the air flow in the vertical direction along the two planes of the sheet-like treatment object. This makes it possible to provide the flow down type surface treating apparatus that enables downsizing without the liquid being mixed into the adjacent treatment chamber.

In the surface treating apparatus according to the present invention, the air flow rate control mechanism has a slit-like guiding part provided near the lower portion of the sheet-like treatment object along the two planes of the sheet-like treatment object, in which the guiding part enables the air suction speed to be increased.

In the surface treating apparatus according to the present invention, the mixing reduction mechanism has a slit-like guiding part provided near the lower portion of the sheet-like treatment object along the two planes of the sheet-like treatment object. This makes it possible to increase the velocity of the air flowing in the vertical direction along the two planes of the sheet-like treatment object.

The surface treating apparatus according to the present invention includes a height adjustment mechanism that adjusts the distance between the opening of the mixing reduction mechanism and the treatment object. This makes it possible to adjust the distance between the opening of the mixing reduction mechanism and the treatment object according to the size of the treatment object.

A surface treating apparatus according to the present invention includes: a first treatment chamber in which a treatment object is carried in a vertically held state; a first processing solution flow down mechanism, provided in the first treatment chamber, for squirting a first processing solution to flow down from the upper portion of the carried treatment object over a surface region of the vertically held treatment object; a second treatment chamber adjacent to the first treatment chamber in which the treatment object is carried in a vertically held state; a second processing solution flow down mechanism, provided in the second treatment chamber, for squirting a second processing solution to flow down from the upper portion of the carried treatment object over a surface region of the vertically held treatment object; a partition wall, provided between the first treatment chamber and the second treatment chamber, having a carry-in opening that enables the treatment object to be carried in through the carry-in opening in a vertically held state; and a mixing reduction mechanism, provided in the first treatment chamber or the second treatment chamber in the vicinity of the partition wall, for reducing the amount of the splashed processing solution that flowed down from the lower portion of the treatment object and has been reflected by a landing surface being mixed into the adjacent treatment chamber through the carry-in opening, in which the mixing reduction mechanism is a splashing direction converting part in which the landing surface is shaped so as to increase its height in a vertical direction as the landing surface comes closer to the carry-in opening.

That is to say, the splashing direction converting part has a shape that the height of the landing surface increases in the vertical direction as the landing surface comes closer to the carry-in opening. Accordingly, the splashing direction can be a direction moving away from the carry-in opening. This makes it possible to provide the flow down type surface treating apparatus that enables downsizing without the liquid being mixed into the adjacent treatment chamber.

In a surface treatment method according to the present invention, when a treatment object is carried in a first treatment chamber in a vertically held state, a first processing solution is squirted toward the upper portion of the carried treatment object to flow down over a surface region of the vertically held treatment object, and when the treatment object to which the first processing solution has been flowed down is carried in a second treatment chamber adjacent to the first treatment chamber in a vertically held state, a second processing solution is squirted toward the upper portion of the carried treatment object to flow down over the surface region of the vertically held treatment object, in which a carry-in opening that enables the treatment object to be carried in through the carry-in opening in a vertically held state is provided between the first treatment chamber and the second treatment chamber. Also, in the first treatment chamber or the second treatment chamber in the vicinity of the partition wall, a plurality of vertically long individual tubular members are arranged so that their openings are oriented to face the vertical direction in order to reduce the amount of the splashed processing solution that flowed down from the lower portion of the treatment object and has been reflected by a landing surface being mixed into the adjacent treatment chamber through the carry-in opening.

This makes it possible to provide the flow down type surface treating apparatus that enables downsizing without the liquid being mixed into the adjacent treatment chamber.

The surface treating apparatus according to the present invention includes: a treatment chamber in which a treatment object is carried in a vertically held state; a processing solution flow down mechanism, provided in the treatment chamber, for squirting a processing solution to flow down from the upper portion of the carried treatment object over a surface region of the vertically held treatment object; a partition wall, provided in the treatment chamber, having a carry-in opening that enables the treatment object to be carried in through the carry-in opening in a vertically held state; and a mixing reduction mechanism, provided in the treatment chamber in the vicinity of the partition wall, for reducing the amount of the splashed processing solution that flowed down from the lower portion of the treatment object and has been reflected by a landing surface being mixed into the outside of the treatment chamber through the carry-in opening, in which the mixing reduction mechanism is arranged to have a shape with a plurality of vertically long individual tubular members so that their openings are oriented to face the vertical direction.

This makes it possible to provide the flow down type surface treating apparatus that enables downsizing without the liquid being mixed into the adjacent treatment chamber.

Although the present invention has been described as a preferred embodiment in the foregoing, it has been used not for purposes of limitation but for purposes of illustration. Therefore, changes can be made within the scope of the claims without surpassing the scope and the spirit of the present invention.

DESCRIPTION OF REFERENCE NUMERALS

60: honeycomb member
61: through-hole
79: splashing direction converting part
80: tray

What is claimed is:

1. A surface treating apparatus comprising:

a treatment chamber in which a treatment object is carried in a vertically held state;

a processing solution flow down mechanism, provided in the treatment chamber, for squirting a processing solution to flow down from an upper portion of the carried treatment object over a surface region of the vertically held treatment object;

a partition wall, provided in the treatment chamber, having a carry-in opening that enables the treatment object to be carried in through the carry-in opening in the vertically held state; and a mixing reduction mechanism, provided in the treatment chamber in a vicinity of the partition wall, for reducing an amount of the splashed processing solution that flowed down from a lower portion of the treatment object and has been reflected by a landing surface or being mixed into an outside of the treatment chamber through the carry-in opening, wherein the mixing reduction mechanism is arranged to have a plurality of vertically long individual tubular members so that their openings are oriented to face a vertical direction.

2. The surface treating apparatus according to claim 1, wherein the treatment chamber is a first treatment chamber, and the processing solution flow down mechanism is a first processing solution flow down mechanism, the surface treating apparatus further comprising, a second treatment chamber adjacent to the first treatment chamber in which the treatment object is carried in a vertically held state; and a second processing solution flow down mechanism that squirts a second processing solution toward the upper portion of the carried treatment object to flow down over a surface region of the vertically held treatment object, wherein the partition wall is provided between the first treatment chamber and the second treatment chamber, and the mixing reduction mechanism is provided in the first treatment chamber or the second treatment chamber in the vicinity of the partition wall.

3. The surface treating apparatus according to claim 2, wherein a shape in which a plurality of vertically long individual tubular members are arranged is a honeycomb-like shape.

4. The surface treating apparatus according to claim 3, wherein the honeycomb-like shape is a honeycomb shape.

5. The surface treating apparatus according to claim 2, further comprising a first processing solution collecting mechanism that collects the first processing solution falling from the lower portion of the treatment object to be fed to the first processing solution flow down mechanism or a second processing solution collecting mechanism that collects the second processing solution falling from the lower portion of the treatment object to be fed to the second processing solution flow down mechanism.

6. The surface treating apparatus according to claim 2, further comprising:

a first processing solution storing part with an exposed liquid surface that stores the first processing solution falling from the lower portion of the treatment object below the treatment object in the first treatment chamber, wherein the liquid surface has a lower surface which is provided with a gap from a surface of the mixing reduction mechanism.

7. The surface treating apparatus according to claim 6, wherein the first processing solution flow down mechanism pumps up the first processing solution stored in the first processing solution storing part and squirts the first processing solution to flow down.

8. The surface treating apparatus according to claim 7, further comprising an air flow rate control mechanism for controlling an air flow so that the processing solution splashing on the landing surface is pulled back in a vertical direction.

9. The surface treating apparatus according to claim 8, wherein the treatment object has a sheet-like shape, and the air flow rate control mechanism has a horizontally long opening with respect to a direction of carry-in toward the sheet-like treatment object, wherein air is sucked from the opening.

10. The surface treating apparatus according to claim 9, wherein the air flow rate control mechanism has a slit-like guiding part provided near the lower portion of the sheet-like treatment object along the two planes of the sheet-like treatment object.

11. The surface treating apparatus according to claim 1, wherein the landing surface is a landing liquid surface or a landing solid surface.

* * * * *